US008203499B2

(12) United States Patent
Cozzolino et al.

(10) Patent No.: US 8,203,499 B2
(45) Date of Patent: Jun. 19, 2012

(54) CONFORMABLE ANTENNA

(75) Inventors: Randell Cozzolino, Phoenix, AZ (US); Gary Wannagot, Gilbert, AZ (US); Snir Azulay, Tiberias (IL)

(73) Assignee: Galtronics Corporation Ltd., Tiberias (IL)

( * ) Notice: Subject to any disclaimer, the term of this patent is extended or adjusted under 35 U.S.C. 154(b) by 277 days.

(21) Appl. No.: 12/468,579

(22) Filed: May 19, 2009

(65) Prior Publication Data

US 2009/0284432 A1 Nov. 19, 2009

Related U.S. Application Data

(60) Provisional application No. 61/128,284, filed on May 19, 2008.

(51) Int. Cl.
*H01Q 9/16* (2006.01)
*H01P 11/00* (2006.01)

(52) U.S. Cl. ..... 343/821; 29/601

(58) Field of Classification Search ..... 343/821, 343/850, 865, 856; 29/601
See application file for complete search history.

(56) References Cited

U.S. PATENT DOCUMENTS

| | | | | |
|---|---|---|---|---|
| 6,445,297 | B1 * | 9/2002 | Nicholson | 340/572.7 |
| 6,549,169 | B1 * | 4/2003 | Matsuyoshi et al. | 343/702 |
| 7,161,548 | B2 * | 1/2007 | Tsukamoto | 343/767 |
| 7,205,953 | B2 * | 4/2007 | Knadle et al. | 343/792.5 |
| 7,427,964 | B2 * | 9/2008 | Sergi | 343/793 |
| 7,463,211 | B2 * | 12/2008 | Mertel et al. | 343/815 |
| 2002/0040466 | A1 * | 4/2002 | Khazei | 716/9 |
| 2002/0175877 | A1 * | 11/2002 | Schantz | 343/850 |
| 2004/0060162 | A1 * | 4/2004 | Moren | 29/601 |

OTHER PUBLICATIONS

An International Search Report dated Aug. 18, 2009, which issued during the prosecution of Applicant's PCT/IL2009/000494.
An International Preliminary Report on Patentability dated Dec. 2, 2010, which issued during the prosecution of Applicant's PCT/IL2009/000494.

* cited by examiner

*Primary Examiner* — Huedung Mancuso
(74) *Attorney, Agent, or Firm* — Sughrue Mion, PLLC

(57) ABSTRACT

A polymorphic antenna, including a metallic template configurable in at least first and second possible different three-dimensional shapes, the antenna, when configured in the at least first and second different three-dimensional shapes, having a common antenna feed point, a common balun coupled to the common antenna feed point; and a common dipole coupled to the common antenna feed point and to the common balun. The antenna operates in a common frequency band when configured in either of the at least first and second different three-dimensional shapes when fed via the common antenna feed point.

23 Claims, 16 Drawing Sheets

CONFORMABLE ANTENNA

CROSS-REFERENCE TO RELATED APPLICATION

This application claims the benefit of U.S. Provisional Patent Application 61/128,284, filed May 19, 2008, which is incorporated herein by reference.

FIELD OF THE INVENTION

The present invention relates generally to antennas, and specifically to compact and cheap antennas that incorporate a balun.

BACKGROUND OF THE INVENTION

Equipment communicating with electromagnetic radiation uses an antenna to receive and transmit the radiation. As pressures increase on manufacturers to reduce the cost of the equipment, while maintaining performance, it is important to reduce as much as possible the costs of each portion of the equipment, including the antenna.

While low-cost antennas are known in the art, there is a continuing need for improvements in antenna design and production to further reduce the costs without compromising the performance of the antenna.

SUMMARY OF THE INVENTION

In an embodiment of the present invention, a template of conducting metallic material is formed from a single sheet of the material. The template, typically planar, is operative as an antenna, and the template may be bent into one of a plurality of different shapes, each shape being operative as a different antenna. The template and the different shapes formed from bending the template comprise two arms of a common dipole coupled to respective common antenna feed points, and also comprise a common balun connected to the two arms and to the feed points.

The template also typically comprises a section which may be configured, typically by bending, as a cable guide. The conducting metallic material is sufficiently thick so that the template, and each antenna formed by bending the template, are free-standing. By virtue of the fact that the template may be deformed into a number of different shapes, the template may be characterized as a polymorphic antenna. Typically, the polymorphic antenna is configured to conform to a dielectric material, such as the housing of a communication device wherein the antenna is operative.

The template is typically formed by stamping the single sheet of the conducting material. The bending of the template usually forms the resulting antenna to be a substantially three-dimensional structure, in contrast to the two-dimensional sheet and template from which the antenna may be produced. Using one template to form multiple antennas is an extremely cost-effect method for producing the antennas.

The antennas formed are center-fed, and use the balun, if present, to allow feeding of the antennas to be from an unbalanced source, typically a coaxial cable, which may be routed via the cable guide.

The two arms of the dipole are typically configured to have different shapes. The differences in shape may be minor, such as is necessary to accommodate an unbalanced feeding source. Alternatively, the differences may be large, for example one arm may be meandered whereas the other arm is not meandered. The dipole operates efficiently in one wavelength band, but unlike a linear dipole, the dipole is typically configured so that a longest length of the antenna is less than the half wavelength required for resonant operation of the linear dipole. The antenna thus occupies significantly less volume than a linear dipole and balun.

The antennas comprise sections that are predominantly operative as the two dipole arms and the balun. However, typically the different sections may not be sharply defined geometrically, and at least a portion of each section may also have secondary operation characteristics. For example, while a balun section operates mainly as a transformer of electromagnetic energy, at least a part of the balun section may also operate in a reduced capacity as a radiator of the electromagnetic energy.

If an intended use is with a coaxial cable, the antenna typically includes one or more cable guides or reliefs, typically formed out of the sheet of conducting material.

Typically, the antenna is configured to mount onto a dielectric material, the mounting being by screwing through holes in the antennas to the dielectric, or by clips formed in the dielectric to receive and hold the antenna, or by one or more other methods known in the art.

In some embodiments the antenna comprises two or more dipoles, so that the antenna is operative at two or more wavelengths or wavelength bands. These embodiments may comprise single or multiple feeds.

Polymorphic antennas according to the present invention typically have an omni-directional radiation pattern. The flexibility of a polymorphic antenna also allows it to be mounted in any convenient orientation, typically within an enclosure of a communication device such as a router, and the orientation may be selected to provide a desired polarization. For example, the orientation may be selected so that the radiation of the antenna is predominantly vertically polarized.

There is therefore provided, according to an embodiment of the present invention, a polymorphic antenna, including:

a metallic template configurable in at least first and second possible different three-dimensional shapes, said antenna, when configured in said at least first and second different three-dimensional shapes, having:

a common antenna feed point;

a common balun coupled to the common antenna feed point; and a common dipole coupled to the common antenna feed point and to the common balun, and said antenna operating in a common frequency band when configured in either of said at least first and second different three-dimensional shapes and fed via the common antenna feed point.

Typically, the antenna when configured in either of said at least first and second different three-dimensional shapes is free-standing.

Typically, the antenna includes a cable guide, and the cable guide and the common balun are formed in a common section of the metallic template. Alternatively or additionally, the cable guide and an arm of the common dipole are formed in a common section of the metallic template.

In one embodiment the common dipole includes a first arm having a first shape and a second arm having a second shape different from the first shape.

In a disclosed embodiment the common dipole includes a first arm and a second arm that is a mirror image of the first arm.

Typically, the antenna includes at least one mounting hole, and the at least one mounting hole and the common balun are formed in a common section of the metallic template. Alternatively or additionally the at least one mounting hole and the common dipole are formed in a common section of the metallic template.

In a disclosed embodiment the common dipole includes a first dipole operative at a first frequency band and a second dipole operative at a second frequency band different from the first frequency band. Typically, the common antenna feed point includes a first antenna feed point coupled to the first dipole and a second antenna feed point coupled to the second dipole. In some embodiments the common balun includes a first balun coupled to the first antenna feed point and a second balun coupled to the second antenna feed point.

There is further provided, according to an embodiment of the present invention, a method for implementing a polymorphic antenna, including:

configuring a metallic template in at least first and second possible different three-dimensional shapes;

arranging said antenna, when the metallic template is configured in said at least first and second different three-dimensional shapes, to have:

a common antenna feed point, a common balun coupled to the common antenna feed point, and a common dipole coupled to the common antenna feed point and to the common balun; and arranging said antenna to operate in a common frequency band when configured in either of said at least first and second different three-dimensional shapes and fed via the common antenna feed point.

There is further provided, according to an embodiment of the present invention, a communication device, including:

a transceiver; and an antenna including:

a metallic template configurable in at least first and second possible different three-dimensional shapes, said antenna, when configured in said at least first and second different three-dimensional shapes, having:

a common antenna feed point coupled to the transceiver;

a common balun coupled to the common antenna feed point; and a common dipole coupled to the common antenna feed point and to the common balun, and said antenna operating in a common frequency band when configured in either of said at least first and second different three-dimensional shapes and fed via the common antenna feed point.

There is further provided, according to an embodiment of the present invention, a method for producing a communication device, including:

providing a transceiver; and coupling an antenna to the transceiver, the antenna including:

a metallic template configurable in at least first and second possible different three-dimensional shapes, said antenna, when configured in said at least first and second different three-dimensional shapes, having:

a common antenna feed point coupled to the transceiver;

a common balun coupled to the common antenna feed point; and a common dipole coupled to the common antenna feed point and to the common balun, and said antenna operating in a common frequency band when configured in either of said at least first and second different three-dimensional shapes and fed via the common antenna feed point.

The present invention will be more fully understood from the following detailed description of the embodiments thereof, taken together with the drawings in which:

DETAILED DESCRIPTION OF EMBODIMENTS

Figure 1:
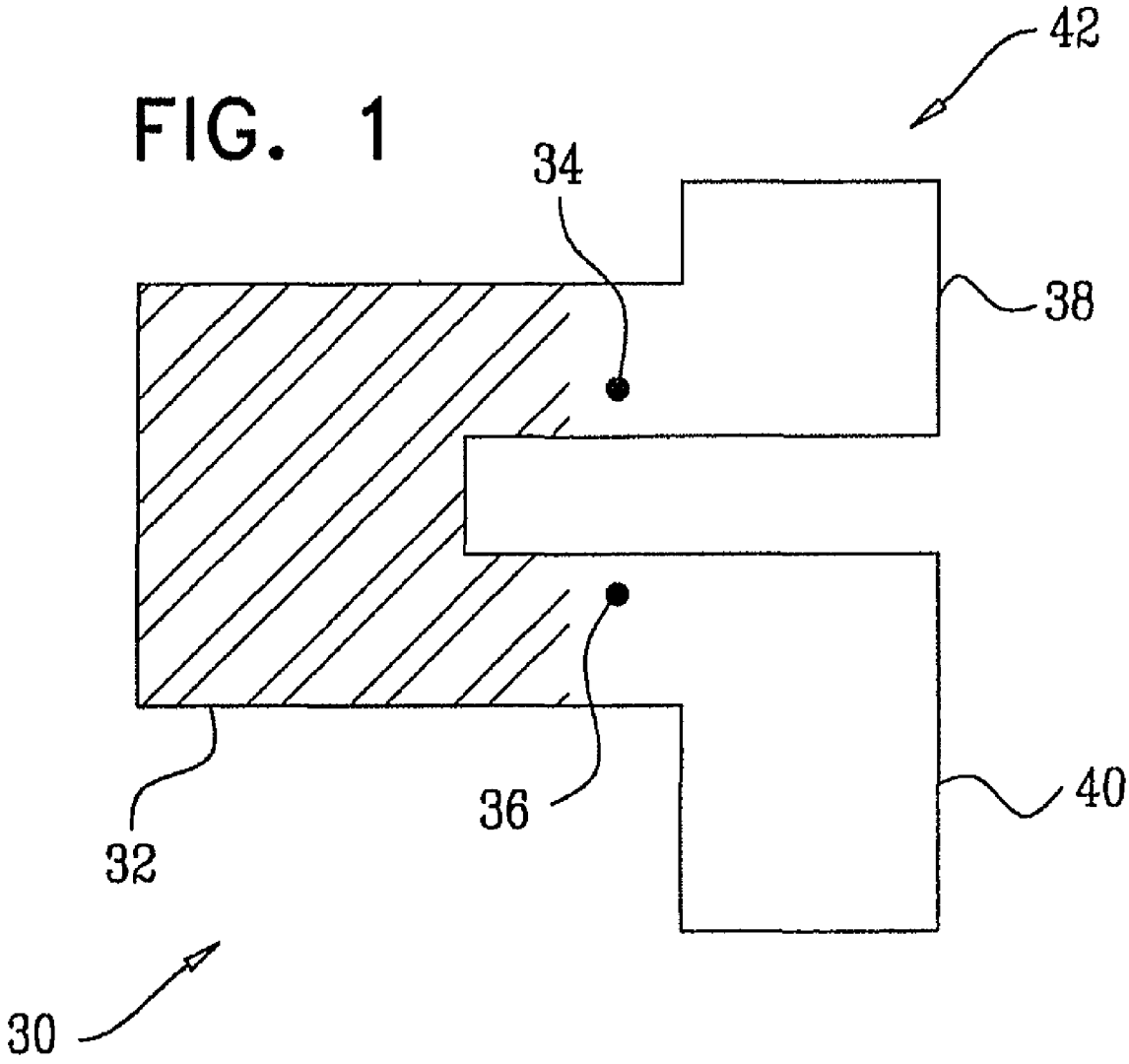
FIG. 1 illustrates sections of a schematic antenna, according to an embodiment of the present invention.

Reference is now made to FIG. 1, which illustrates sections of a schematic antenna 30, according to an embodiment of the present invention. Schematic antenna 30 comprises a balun 32 which is connected to two arms 38, 40 of a dipole 42. Dipole 42 has two feed points 34, 36 at inner ends of arms 38, 40, the dipole thus operating as a center-fed dipole. The two feed points are also herein termed live feed point 34 and ground feed point 36. Balun 32, arms 38, 40, of dipole 42, and feed points 34, 36 of the dipole are respectively also referred to herein as balun, arms, dipole and live and ground feed point sections of schematic antenna 30, and the antennas described hereinbelow are formed of these sections.

Embodiments of the present invention are typically formed from a planar conducting template of metallic material. As is described in more detail below, each template may be defined completely by a two-dimensional surface, so that the template may be considered to be two-dimensional. While the template may be considered as two-dimensional, it has sufficient thickness so that it, and any shape formed by bending the template, is free-standing. The template, and the different shapes formed by bending the template, are each operative as antennas, so that the template may be characterized as a polymorphic antenna. Typically the polymorphic antennas described herein are configured to conform with another structure. For example, a polymorphic antenna may be bent to fit into the dielectric housing of a communication device within which the antenna is operative.

In the antennas described hereinbelow the different sections, described above with reference to schematic antenna 30, may not be sharply defined geometrically, but are generally delineated by the feed point sections. Thus balun section 32 is a generally U-shaped conducting region between live feed point section 34 and ground feed point section 36. For clarity, in FIG. 1 balun section 32 of antenna 30 is shown hatched. Arm section 38 is a conducting region, not including the balun section, having the live feed point section at one end of the arm section. Arm section 36 is a conducting region, not including the balun section, having the ground feed point section at one end of the arm section.

In the description of embodiments of the present invention below, because the sections of a given antenna may be imprecisely defined geometrically, a section referred to as a balun is a region at least part of which has predominantly balun characteristics, so that the function of the balun section is primarily as a transformer of electromagnetic energy. Similarly a section referred to as an arm of a dipole is a region at least part of which has predominantly dipole characteristics, so that the function of the arm section is primarily as a radiator or absorber of electromagnetic radiation. However, a balun section may operate in a secondary, minor, role as a radiator. Similarly, an arm section may operate in a secondary, minor, role as a transformer or balun.

For simplicity and clarity, in the figures described herein, the balun section of each given antenna is shown with the same hatching as is used in FIG. 1. It will be understood that the hatching is schematic, and is only illustrative of a region that typically operates predominantly as a balun.

Sections of antennas described herein may be configured to perform multiple functions. For example, an arm section may have holes in the arm that act as mounting holes for the antenna; a balun section may include a hole used for a cable guide. In some cases, a region of a section may perform to a limited extent the predominant characteristic of the section. For example, in a balun section having a region that is used for mounting the antenna, the mounting region may transform little or no electromagnetic energy. Such cases will be apparent to those having ordinary skill in the antenna art.

Antennas described herein are typically fed by a coaxial cable, i.e., an unbalanced source, in which case one of the feed point sections, herein also termed the live feed point section, of a particular antenna is connected to the center conductor of the cable. The other feed point section, herein also termed the ground feed point section, is connected to the outer conductor of the cable.

Embodiments of the present invention may be operated efficiently at many different wavelengths and/or in one or more wavelength bands, the wavelength of operation of a given antenna being set, inter alia, by the dimensions of the antenna. By way of example, for single band antennas described herein the band of operation is assumed to be approximately centered on 2.5 GHz or 5 GHz; for dual band antennas described herein the bands of operation are assumed to be approximately centered on 2.5 GHz and 5 GHz. A linear dipole operating at 2.5 GHz, in an environment where the dielectric constant is effectively unity, typically has a total length of approximately 60 mm, corresponding to half the wavelength of electromagnetic radiation at a frequency of 2.5 GHz in free space. A linear dipole operating at 5 GHz has a total length of approximately 30 mm. As is apparent from the description below, embodiments of the present invention typically form at least one of the dipole arm sections to be non-linear, such as by meandering and/or bending the arm section, so reducing the bulk of the antenna.

Figure 2A:
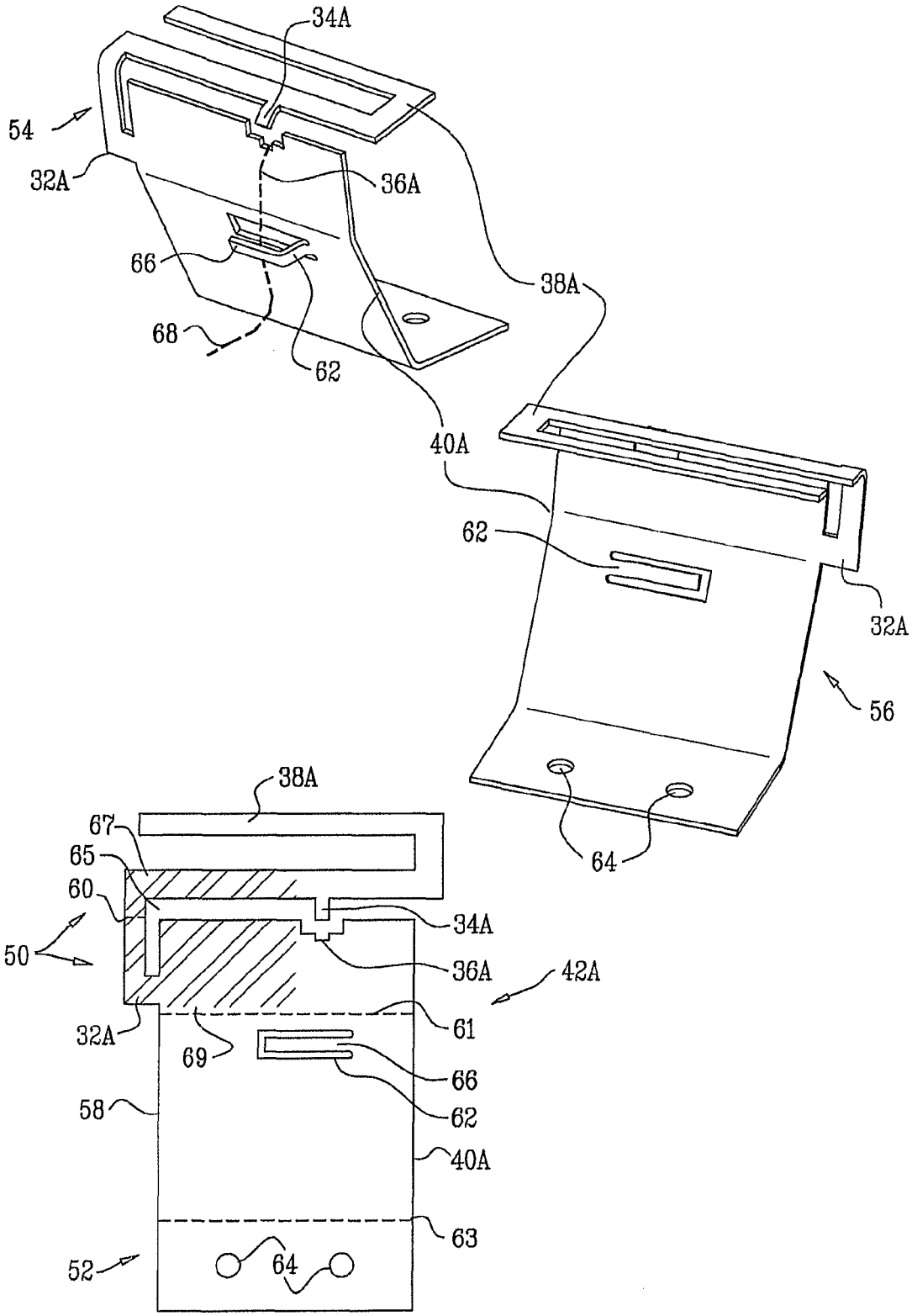
FIGS. 2A, 2B, and 2C are schematic diagrams of antennas, according to an embodiment of the present invention.
Figure 2B:
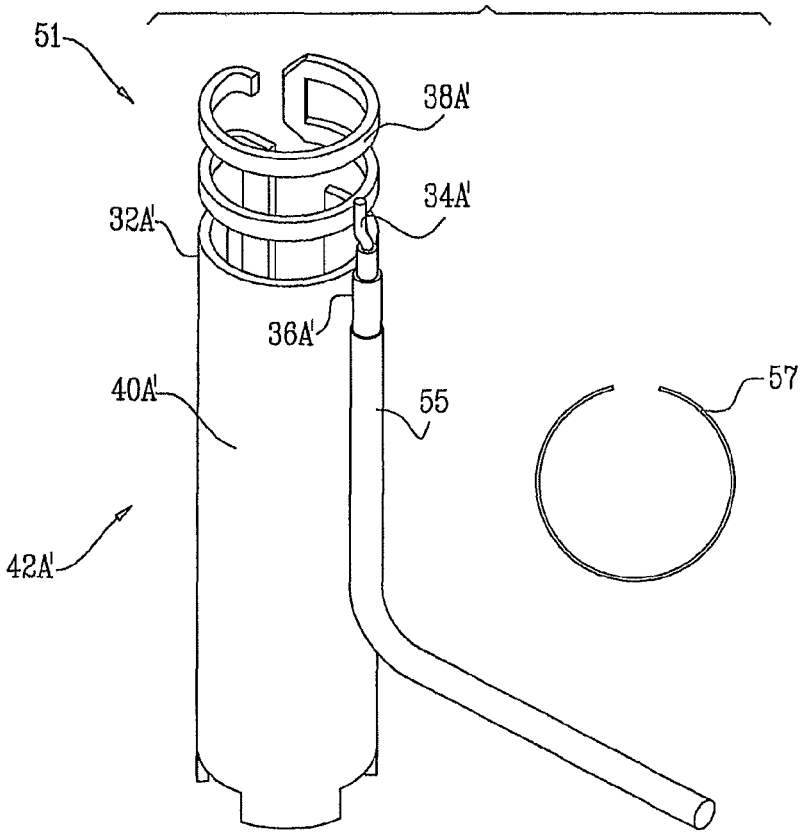
Figure 3A:
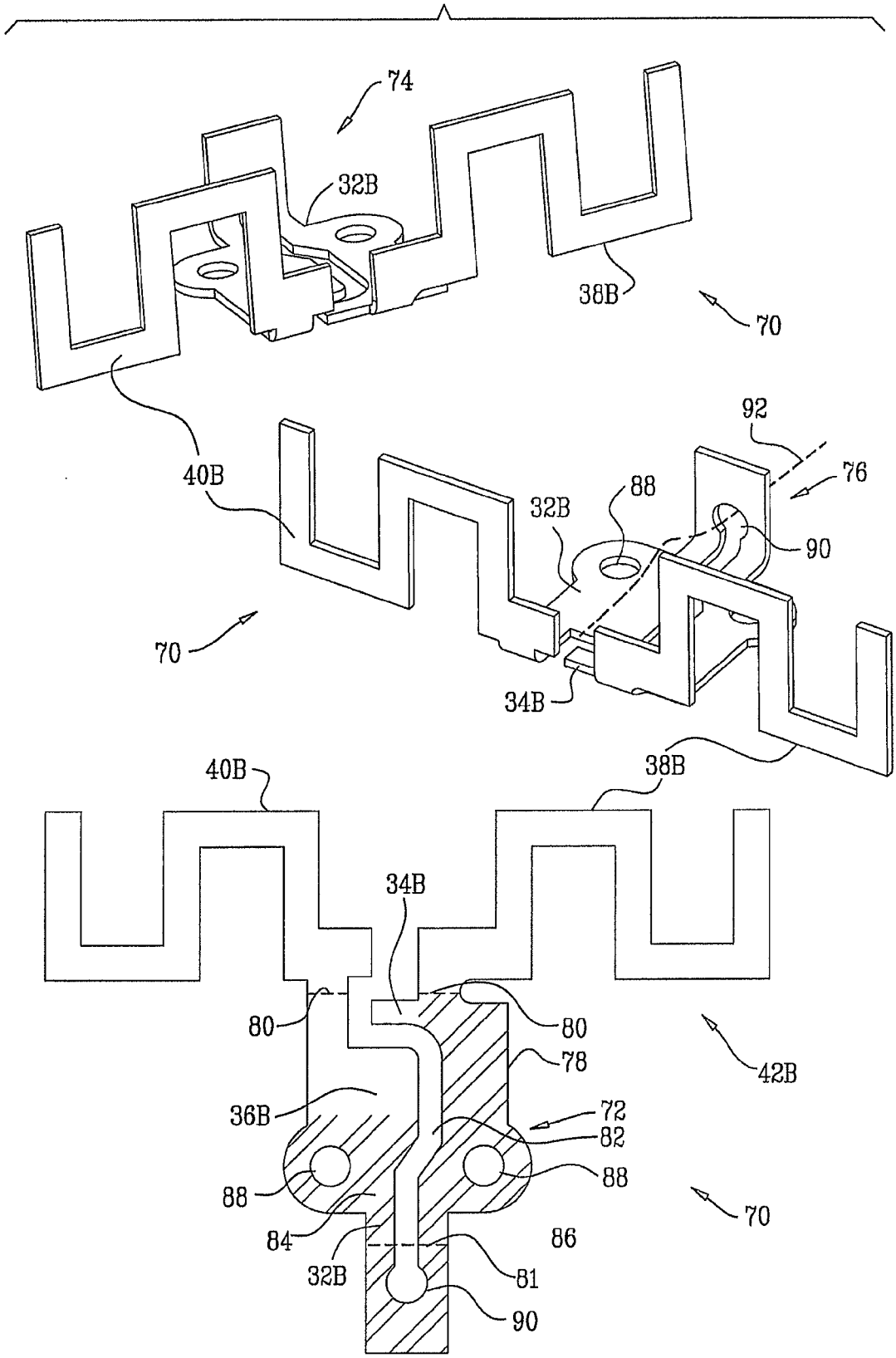
FIGS. 3A and 3B are schematic diagrams of alternative antennas, according to an embodiment of the present invention.

In the descriptions below, each section of an antenna is referred to by a numeral, corresponding to the respective section of schematic antenna 30, followed by a letter suffix. The letter suffix identifies the antenna. For example, in FIG. 2A, illustrating an antenna 50, antenna 50 comprises a live feed point section 34A and a ground feed point section 36A. In FIG. 3A, illustrating an antenna 70, antenna 70 comprises a live feed point section 34B and a ground feed point section 36B. For different antennas that may be formed from the same template, corresponding sections of the different antennas are identified by one or more apostrophes after the letter suffix. For example, in FIG. 2B, illustrating an antenna 51 derived from the same template as antenna 50, antenna 51 comprises a live feed point section 34A' and a ground feed point section 36A'.

For antennas having two or more sections that perform similar functions, a distinguishing numeral is affixed after the letter suffix. For example, in FIG. 8, an antenna 220 comprises a first dipole section 42G1 and a second dipole section 42G2.

By way of example, in the following description, antennas may comprise mounting holes, which may be used for screws, heat stakes, and/or as the anchors for pins which are pressed into the holes. However, other convenient mounting methods, such as using double-sided adhesive tape, glue, or snapping the antennas into an antenna holder, may be used for mounting, and these and other methods for mounting will be familiar to those having ordinary skill in the art. All such methods are assumed to be comprised within the scope of the present invention.

FIG. 2A is a schematic diagram of antenna 50, according to an embodiment of the present invention. Antenna 50 is a single band antenna that is assumed to operate, by way of example, at 2.5 GHz. FIG. 2A shows three views of antenna 50: a first view 52 is of the antenna before it is formed into its final shape, a second view 54 and a third view 56 are perspective views of antenna 50 in its finished form. View 52 is of a two-dimensional surface defining a planar conductive template 58 that has been formed, typically by stamping from a conductive metallic sheet, into the shape shown in view 52. Antenna 50 is then formed into its finished three-dimensional shape by bending template 58 along lines 60, 61, and 63.

In addition to live feed point section 34A and ground feed point section 36A, antenna 50 comprises a balun section 32A. A dipole section 42A comprises a first arm section 38A and a second arm section 40A. As is shown in views 54 and 56, balun section 32A is a non-planar region that is formed by bending a planar section about line 60; arm section 38A is planar, and is meandered; and second arm section 40A is a non-planar non-meandered region that is formed by bending a rectangular-shaped section about lines 61 and 63. Balun 32A is a generally irregular-U-shaped region, having an L-shaped opening 65 separating a first side 67 and a second side 69 of the balun. Side 67 and arm section 38A are coplanar. Side 69 is coplanar and continuous with the portion of arm section 40A to which it connects.

A cable guide 62 and optional mounting holes 64 are formed in antenna 50, the guide and the holes typically being positioned approximately in arm section 40A. As illustrated in view 54, guide 62 is formed by bending a tongue 66 of the template so that the guide is able to retain a cable. View 54 also shows, as a broken line 68, a typical path of a cable retained by guide 62 and connected to regions 34A and 36A. Typical overall dimensions of template 58 are approximately 35 mm×22 mm, and antenna 50 when formed into its three-dimensional shape occupies a volume having approximate dimensions of 21 mm×22 mm×9 mm.

The overall dimensions of template 58 may be altered, typically by simulation, so as to optimize the performance of antenna 50. In addition, dimensions and/or locations of the sections comprising antenna 50, such as the positions of feed points 34A, 36A, may be adjusted, typically also by simulation, to optimize the performance of the antenna.

For any given antenna described hereinbelow, the overall dimensions of the template from which the given antenna is formed, and the dimensions and/or locations of the sections comprising the given antenna, may be adjusted in a manner similar to that described for antenna 50, so as to optimize the performance of the given antenna.

FIG. 2B is a schematic diagram of an antenna 51, according to an embodiment of the present invention. Antenna 51 is formed from the same template, template 58, as antenna 50, but, as described below, the template is bent differently from the bending described for antenna 50. Except for the differences described below, antennas 50 and 51 are structurally similar, and have generally similar operational characteristics. For simplicity, only the sections corresponding to those illustrated in FIG. 1, for antenna 30, are labeled in FIG. 2B. Also for simplicity, some of the details of template 58, such as tongue 66, are not shown in FIG. 2B. As illustrated, antenna 51 comprises a balun section 32A', arm sections 38A', 40A' of a dipole section 42A', and feed point sections 34A', 36A' of the dipole section. A coaxial cable 55 is coupled to feed point sections 34A', 36A'.

Antenna 51 is formed by bending template 58 about an axis parallel to the long side of the template, so as that the resulting antenna has a generally cylindrical form. The antenna has an open circular cross-section so that the edges of template 58 do not meet after the template has been bent. An open circle 57 is a cross-section of antenna 51 taken orthogonal to the bending axis at feed point section 34A'. By way of example, antenna 51 occupies a cylindrical volume that is approximately 35 mm long having a diameter of approximately 7 mm.

Figure 2C:
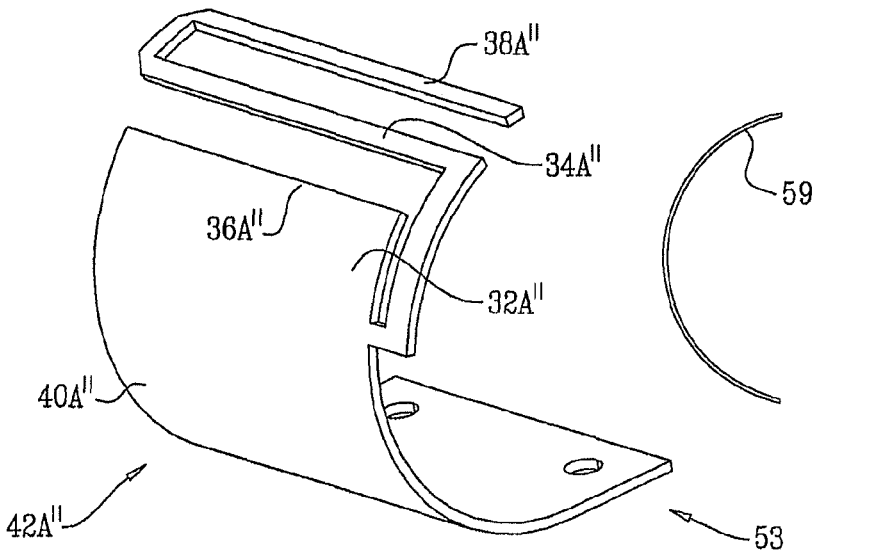

FIG. 2C is a schematic diagram of an antenna 53, according to an embodiment of the present invention. Antenna 53 is formed from the same template, template 58, as antennas 50 and 51, but the template is bent differently from the bending described for antennas 50 and 51. Except for the differences described below, antennas 50, 51 and 53 are structurally similar, and have generally similar operational characteristics. For simplicity, only the sections corresponding to those illustrated in FIG. 1, for antenna 30, are labeled in FIG. 2C. Also for simplicity, some of the details of template 58, such as tongue 66 and the detail of the feed point sections, are not shown in FIG. 2C. As illustrated, antenna 53 comprises a balun section 32A", arm sections 38A", 40A" of a dipole section 42A", and feed point sections 34A", 36A" of the dipole section.

Antenna 53 is formed by bending template 58 about an axis parallel to the short side of the template, so that antenna 53 has a generally arcuate form. A section of antenna 53 taken at feed point section 34A" and orthogonal to the bending axis is a cross-section 59. By way of example, antenna 53 occupies a volume having approximate dimensions similar to those of antenna 50, i.e., 25 mm×22 mm×9 mm.

It will be understood that in addition to antennas 50, 51, and 53 described above, planar template 58 may also be used as an antenna substantially "as is," i.e., without bending.

Consideration of FIGS. 2A, 2B, and 2C show that antennas 50, 51, and 53, formed from the same template 58, have a common antenna feed point, comprising the live and ground feed point sections of the respective antennas. Antennas 50, 51, and 53 also have a common balun and a common dipole, respectively corresponding to the balun sections and the dipole sections of the antennas.

It will be apparent that other antennas described hereinbelow, formed from the same template, have a common antenna feed point, a common balun, and a common dipole.

FIG. 3A is a schematic diagram of antenna 70, according to an embodiment of the present invention. Antenna 70 is a single band antenna operating at approximately the same frequency as antenna 50. FIG. 3A shows three views of antenna 70: a first view 72 is of the antenna before it is formed into its final shape, a second view 74 and a third view 76 are perspective views of the antenna in its finished form. View 72 is of a two-dimensional surface defining a two-dimensional conductive template 78 that has been formed, typically as described for antenna 50, into the shape shown in view 72. Antenna 70 is then formed into its finished shape by bending template 78 along lines 80, 81.

Antenna 70 comprises live feed point section 34B and ground feed point section 36B. Antenna 70 also comprises a balun section 32B which is non-planar. A dipole section 42B of the antenna is formed of a first arm section 38B and a second arm section 40B. As is shown in FIG. 3A, both arm sections 38B and 40B are planar and are meandered, are approximately mirror images of each other, and are coplanar. However, inspection of view 72 shows that antenna 70 does not have a mirror line, or a mirror plane. Rather, a separation gap 82 between two sides 84, 86 of balun section 32B is an asymmetrical space that is configured to provide ground feed point section 36B with sufficient area for easy connection of a cable shield. As is seen in views 74, 76, portions of sides 84, 86, connecting to arm sections 40B and 38B at bend line 80, are approximately orthogonal to the arm sections.

Optional mounting holes 88 are formed in balun section 32B. Also formed in section 32B, as illustrated in view 72, is a cable guide hole 90. View 76 shows, as a broken line 92, a typical path of a cable retained by hole 90 and connected to regions 34B and 36B. Typical overall dimensions of template 78 are approximately 30 mm×23 mm, and antenna 70 when formed into its three-dimensional shape occupies a volume having approximate dimensions of 30 mm×12 mm×8 mm. To optimize the performance of antenna 70, the dimensions and/or locations and/or characteristics of the sections comprising the antenna, such as the size and/or number of meanders of arm sections 38B, 40B, may be adjusted, as described above for antenna 50.

Figure 3B:
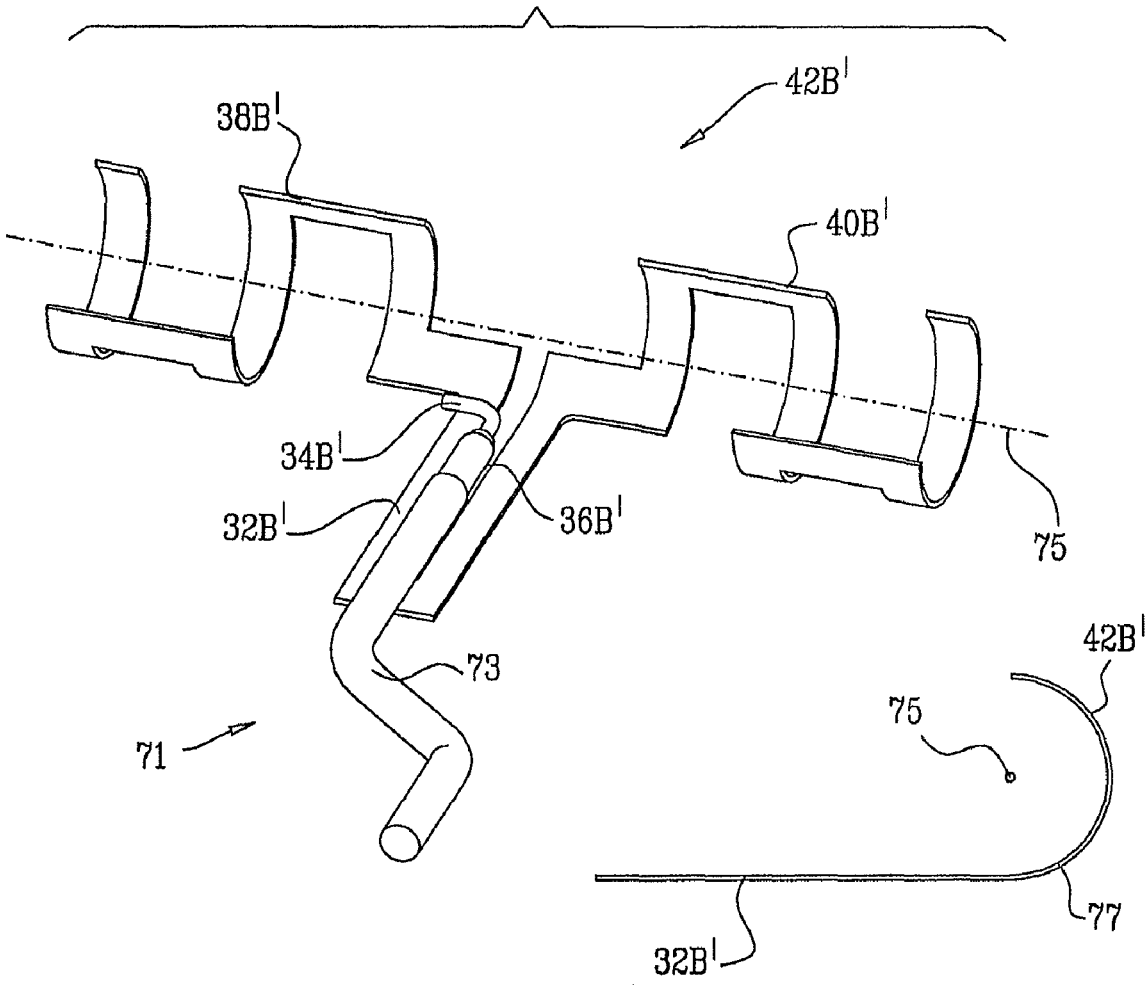

FIG. 3B is a schematic diagram of an antenna 71, according to an embodiment of the present invention. Antenna 71 is formed from the same template 78 as antenna 70, but, as described below, the template is bent differently from the bending described for antenna 70. Except for the differences described below, antennas 70 and 71 are structurally similar, and have generally similar operational characteristics. For simplicity, only the sections corresponding to those illustrated in FIG. 1, for antenna 30, are labeled in FIG. 3B. Also for simplicity, some of the details of template 78, such as mounting holes 88, are not shown in FIG. 3B. As illustrated, antenna 71 comprises a balun section 32B', arm sections 38B', 40B' of a dipole section 42B', and feed point sections 34B', 36B' of the dipole section. A coaxial cable 73 is coupled to feed point sections 34B', 36B'.

Antenna 71 is formed by bending dipole section 42B' of template 78 about an axis 75 that is a direction defined by dipole section 42B'. The bending forms the dipole section to have a generally semicircular cross-section, while balun section 32B' remains substantially plane. A cross-section 77 is of antenna 71 taken orthogonal to bending axis 75. By way of example, antenna 71 occupies a volume that has approximate dimensions of 30 mm×20 mm×9 mm.

In addition to antennas 70 and 71, planar template 78 may also be used as an antenna substantially as is, i.e., without bending.

The descriptions above illustrate that a single template, template 58 for antennas 50, 51, and 53, and template 78 for antennas 70 and 71, may be characterized as a polymorphic antenna, since each template may be bent into a plurality of differently shaped antennas, or used as an antenna without bending. All the antennas formed from a given template have similar properties, for example operating at substantially the same wavelengths or wavelength bands. However, there will typically be some differences in the performance of each antenna due to their different shapes.

The following description provides further examples of templates, each of which may be considered to be a polymorphic antenna. For simplicity, except where otherwise indicated, for each template only one example of an antenna formed by bending the template is given. Those having ordinary skill in the art will be able to derive other antennas for each template by bending the template.

Figure 4:
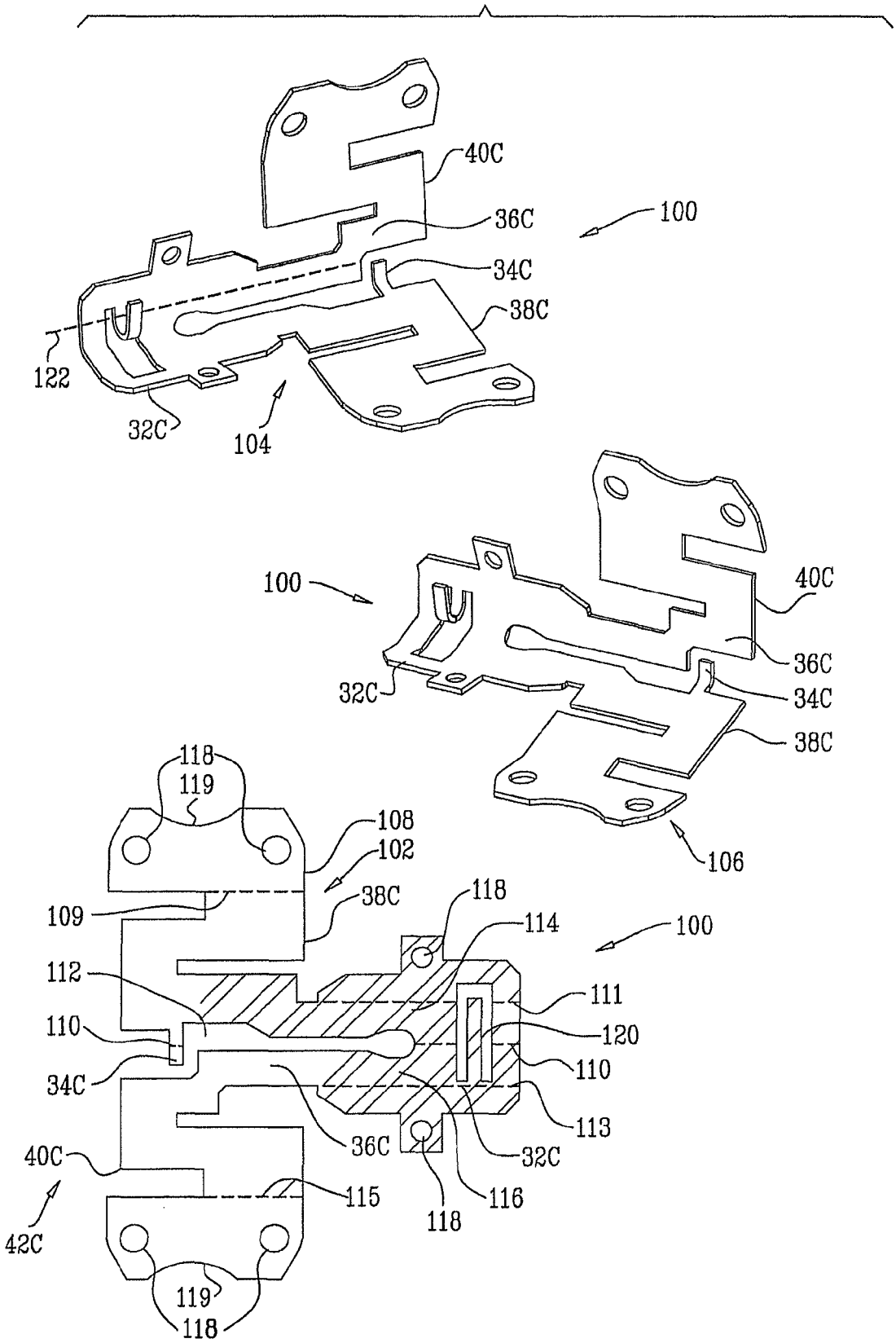
FIG. 4-FIG. 13 are schematic diagrams of further alternative antennas, according to an embodiment of the present invention.

FIG. 4 is a schematic diagram of an antenna 100, according to an embodiment of the present invention. Antenna 100 is a single band antenna operative at approximately the same frequency as antenna 50. FIG. 4 shows three views of antenna 100: a first view 102 is of the antenna before it is formed into its final shape, a second view 104 and a third view 106 are perspective views of the antenna in its finished form. View 102 is a two-dimensional surface defining a conductive template 108 that has been formed, typically as described for antenna 50, into the shape shown in view 102. Antenna 100 is then formed into its finished shape by bending template 108 along lines 109, 110, 111, 113 and 115.

Antenna 100 comprises a live feed point section 34C and a ground feed point section 36C. Antenna 100 also comprises a non-planar balun section 32C that has a generally V-shaped cross-section, with an apex of the V corresponding to bend line 110. A dipole section 42C of the antenna is formed of a first arm section 38C and a second arm section 40C. Both arm sections 38C and 40C are non-planar and meandered, and are approximately mirror images of each other. However, inspection of view 102 shows that antenna 100 does not have a mirror line, or a mirror plane. For example, a separation gap 112 between two sides 114, 116 of balun section 32C is an asymmetrical region. A portion of side 114 is coplanar and continuous with a portion of arm section 38C; a portion of side 116 is coplanar and continuous with a portion of arm section 36C.

Optional holes 118 are formed in balun section 32C and in arm sections 38C and 40C. Optional indentations 119 may be formed in sections 38C and 40C. The holes and/or the indentations are configured so that antenna 100 conforms to a structure wherein antenna 100 is operative, so that the antenna is easily mounted to the structure. Also formed in section 32C, as illustrated in view 102, is an optional cable grip 120. View 104 shows, as a broken line 122, a typical path of a cable, retained by grip 120 after the grip has been bent, and the cable is connected to regions 34C and 36C.

Typical overall dimensions of template 108 are approximately 34 mm×30 mm, and antenna 100 when formed into its three-dimensional shape occupies a volume having approximate dimensions of 21 mm×30 mm×18 mm. To optimize performance of antenna 100 the dimensions and/or locations and/or characteristics of the sections comprising the antenna may be altered, generally as described above with reference to antennas 50 and 70.

Figure 5:
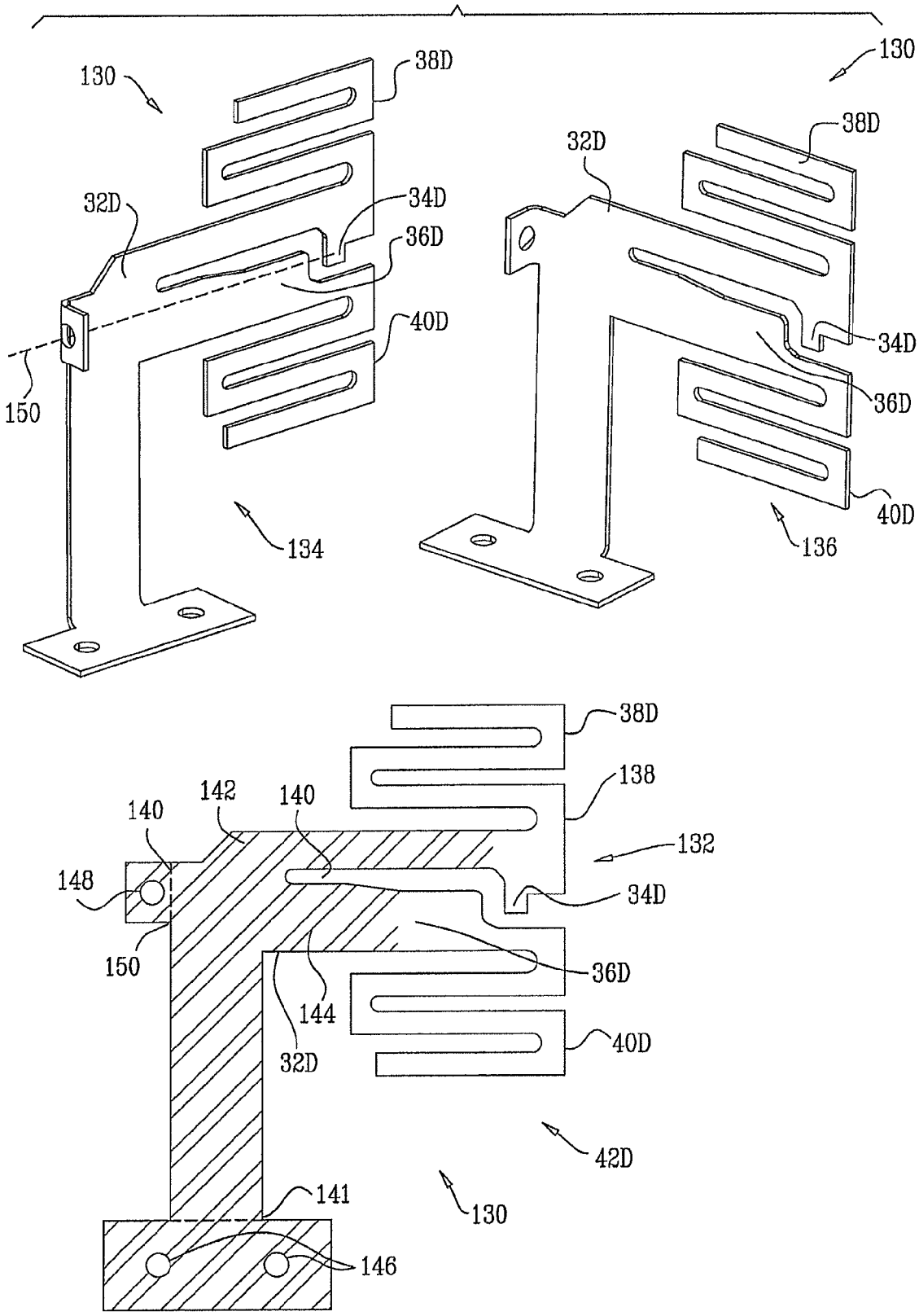

FIG. 5 is a schematic diagram of an antenna 130, according to an embodiment of the present invention. Antenna 130 is a single band antenna operative at approximately the same frequency as antenna 50. FIG. 5 shows three views of antenna 130: a first view 132 is of the antenna before it is formed into its final shape, a second view 134 and a third view 136 are perspective views of the antenna in its finished form. View 132 is of a two-dimensional surface defining a conductive template 138, that has been formed, typically as described for antenna 50, into the shape shown in view 132. Antenna 130 is then formed into its finished shape by bending template 138 along lines 140, 141.

Antenna 130 comprises a live feed point section 34D and a ground feed point section 36D. Antenna 130 also comprises a non-planar balun section 32D. A dipole section 42D of the antenna is formed of a first arm section 38D and a second arm section 40D. Both arm sections 38D and 40D are planar and meandered, and are approximately mirror images of each other. The planar arm section are coplanar with each other. However, inspection of view 132 shows that antenna 130 does not have a mirror line, or a mirror plane. For example, a separation gap 140 between two sides 142, 144 of balun section 32D is an asymmetrical space. Portions of sides 142 and 144 connecting to arm sections 38D and 36D are continuous and coplanar with the arm sections.

Optional mounting holes 146 are formed in balun section 32D. Also formed in section 32D, as illustrated in view 132, is a cable retaining hole 148. View 134 shows, as a broken line 150, a typical path of a cable feeding through hole 148 after template 138 has been bent to its final shape. The cable is connected to regions 34D and 36D.

Typical overall dimensions of template 138 are approximately 40 mm×30 mm, and antenna 130 when formed into its three-dimensional shape occupies a volume having approximate dimensions of 35 mm×30 mm×5 mm. To optimize performance of antenna 130 the dimensions and/or locations and/or characteristics of the sections comprising the antenna may be altered, generally as described above with reference to antennas 50 and 70.

Figure 6:
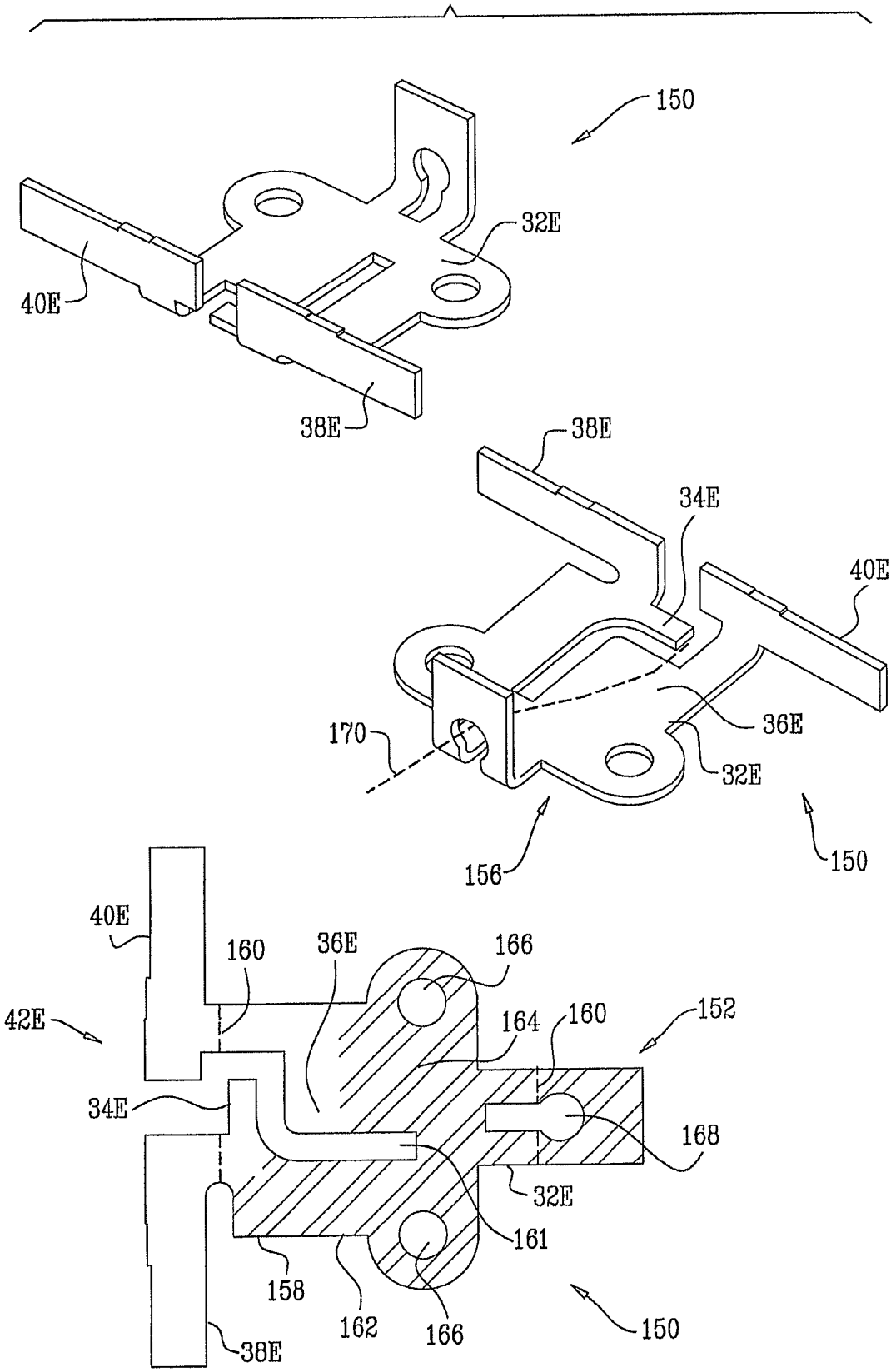

FIG. 6 is a schematic diagram of an antenna 150, according to an embodiment of the present invention. Antenna 150 is a single band antenna operative, by way of example, at approximately 5 GHz. FIG. 6 shows three views of antenna 150: a first view 152 is of the antenna before it is formed into its final shape, a second view 154 and a third view 156 are perspective views of the antenna in its finished form. View 152 is of a two-dimensional surface defining a conductive template 158, that has been formed, typically as described for antenna 50, into the shape shown in view 152. Antenna 150 is then formed into its finished shape by bending template 158 along lines 160.

Antenna 150 comprises a live feed point section 34E and a ground feed point section 36E. Antenna 150 also comprises a non-planar balun section 32E. A dipole section 42E of the antenna is formed of a first arm section 38E and a second arm section 40E. Both arm sections 38E and 40E are planar and substantially linear, and are approximately mirror images of each other. View 152 shows that antenna 150 does not have a mirror line, or a mirror plane since a separation gap 161 between two sides 162, 164 of balun section 32E is asymmetrical.

Optional mounting holes 166 are formed in balun section 32E. Also formed in section 32E is an optional cable retaining hole 168. View 156 shows, as a broken line 170, a typical path of a cable feeding through hole 168 after template 158 has been bent to its final shape. The cable is connected to regions 34E and 36E.

Typical overall dimensions of template 158 are approximately 22 mm×18 mm, and antenna 150 when formed into its three-dimensional shape occupies a volume having approximate dimensions of 22 mm×12 mm×5 mm. To optimize performance of antenna 150 the dimensions and/or locations and/or characteristics of the sections comprising the antenna may be altered, generally as described above with reference to antenna 50.

Figure 7:
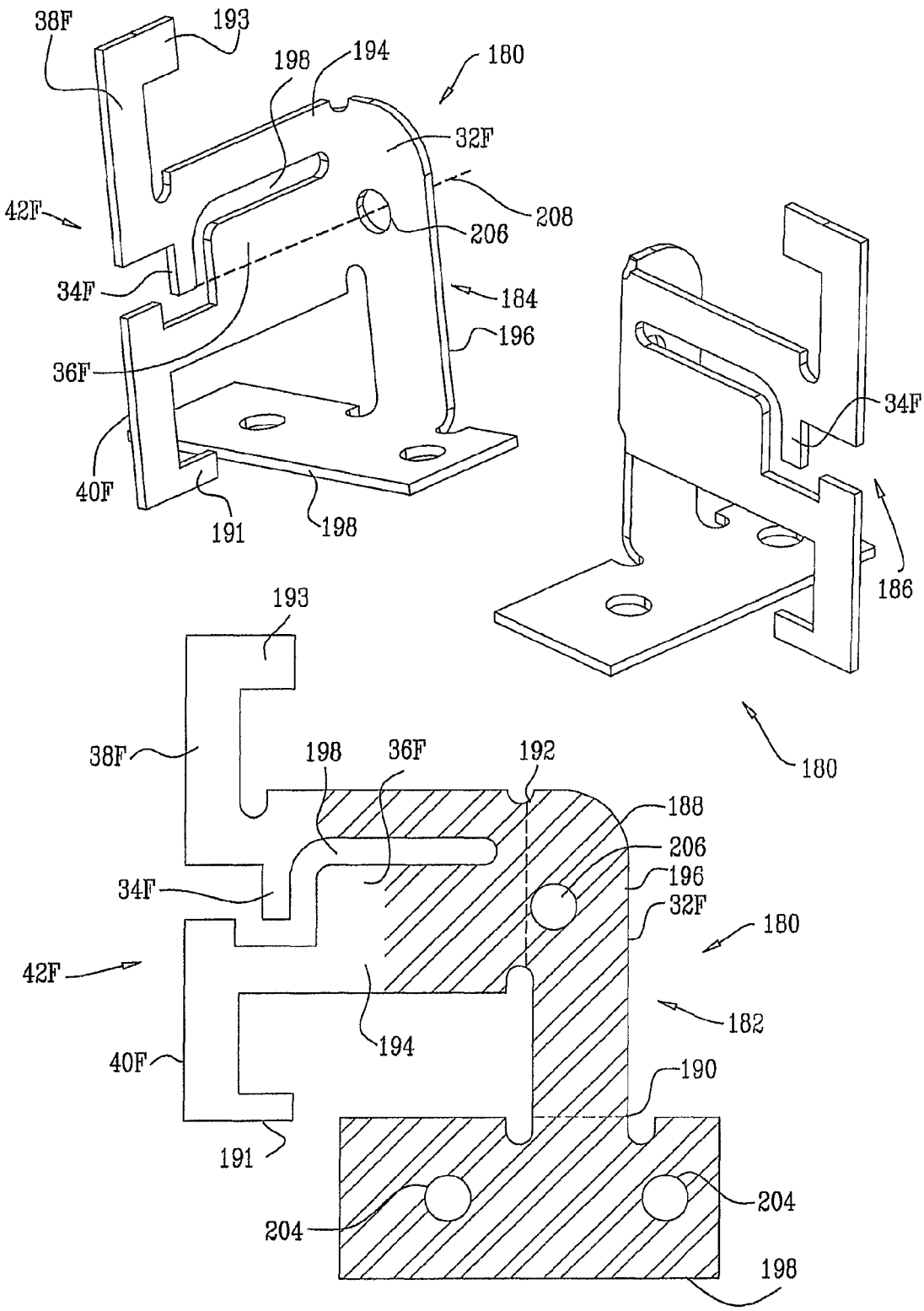

FIG. 7 is a schematic diagram of an antenna 180, according to an embodiment of the present invention. Antenna 180 is a single band antenna operative, by way of example, at approximately 5 GHz. FIG. 7 shows three views of antenna 180: a first view 182 is of the antenna before it is formed into its final shape, a second view 184 and a third view 186 are perspective views of the antenna in its finished form. View 182 is of a two-dimensional surface defining a conductive template 188, that has been formed, typically as described for antenna 50, into the shape shown in view 182. Antenna 180 is then formed into its finished shape by bending template 188 along lines 190, 192.

Antenna 180 comprises a live feed point section 34F and a ground feed point section 36F. Antenna 180 also comprises a non-planar balun section 32F. A dipole section 42F of the antenna is formed of a first arm section 38F and a second arm section 40F. Both arm sections 38F and 40F are planar and coplanar with each other and are non-linear, each arm section being in the general form of an "L." While the two arm sections are approximately mirror images of each other, an end element 191 of arm section 40F has a width approximately half that of the width of a corresponding end section 193 of arm section 38F.

Balun section 32F is formed of three mutually orthogonal planar sections 194, 196, and 198, the sections being connected together about bend lines 190 and 192. Section 194 of the balun has a separation gap 198 between two sides 200, 202 of section 194. Section 194 is coplanar and is continuous with arm sections 38F and 40F.

Optional mounting holes 204 are formed in balun section 32F. Also formed in section 32F is an optional cable retaining hole 206. View 184 shows, as a broken line 208, a typical path of a cable feeding through hole 206 after template 188 has been bent to its final shape. The cable is connected to regions 34F and 36F.

Typical overall dimensions of template 188 are approximately 24 mm×20 mm, and antenna 180 when formed into its three-dimensional shape occupies a volume having approximate dimensions of 18 mm×14 mm×12 mm. To optimize performance of antenna 180 the dimensions and/or locations and/or characteristics of the sections comprising the antenna may be altered, generally as described above with reference to antennas 50 and 70.

Figure 8:
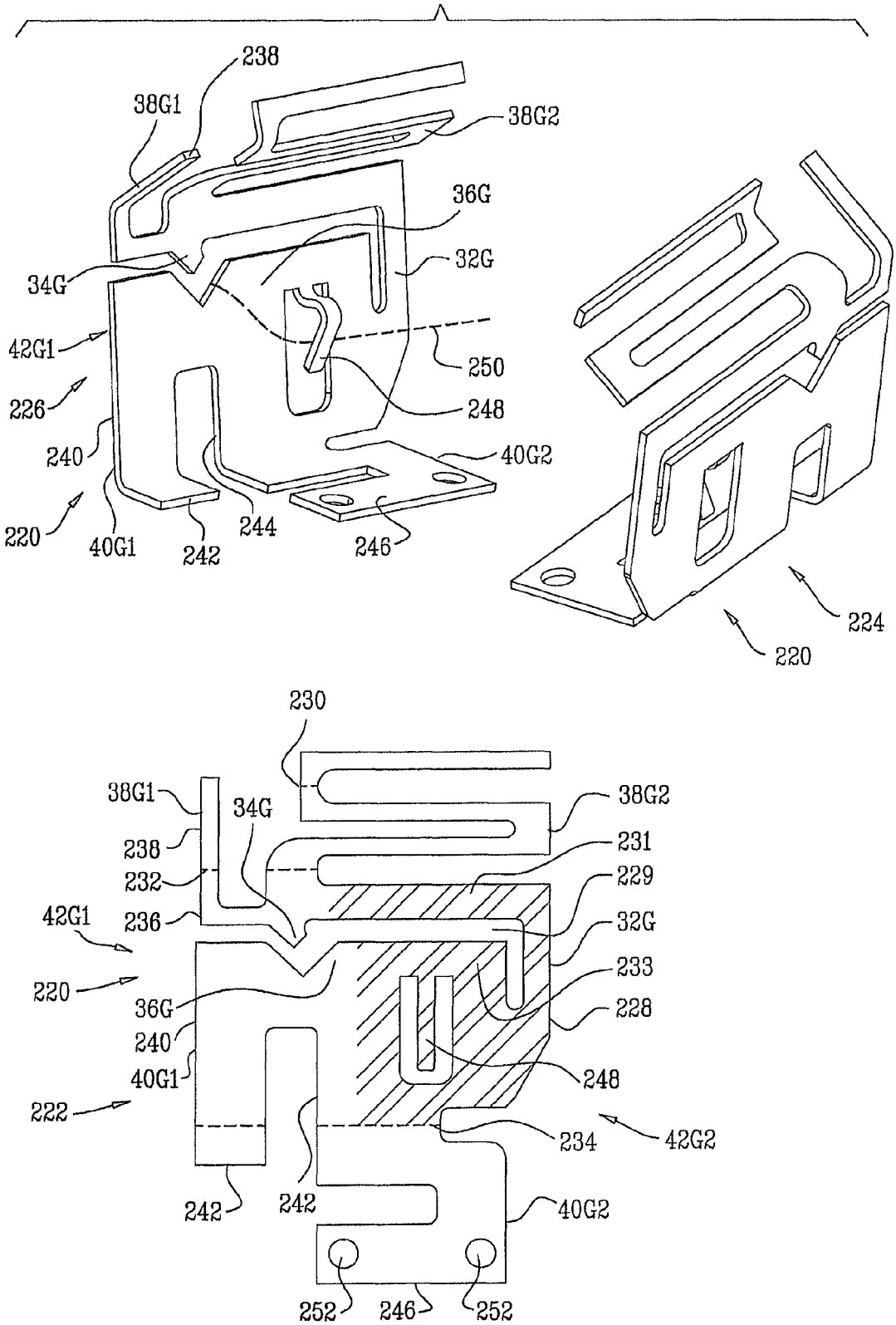

FIG. 8 is a schematic diagram of an antenna 220, according to an embodiment of the present invention. Antenna 220 is a single-feed dual band antenna operative, by way of example, at approximately 2.5 GHz and 5 GHz. FIG. 8 shows three views of antenna 220: a first view 222 is of the antenna before it is formed into its final shape, a second view 224 and a third view 226 are perspective views of the antenna in its finished form. View 222 is of a two-dimensional surface defining a conductive template 228, that has been formed, typically as described for antenna 50, into the shape shown in view 222. Antenna 220 is then formed into its finished shape by bending template 228 along lines 230, 232, and 234.

Antenna 220 comprises a live feed point section 34G and a ground feed point section 36G. A first dipole section 42G1 of the antenna is formed of a first arm section 38G1 and a second arm section 40G1. A second dipole section 42G2 of the antenna is formed of a first arm section 38G2 and a second arm section 40G2. Antenna 220 comprises a balun section 32G, which acts as a common balun for the first and the second dipole sections.

In first dipole section 42G1 arm section 38G1 comprises a first section 236 and a second section 238, angled with respect to section 236 by being bent at line 232. Arm section 40G1 comprises a first section 240 and a second section 242, angled with respect to section 240 by being bent at line 234. Arm sections 38G1 and 40G1 have different widths and different lengths.

In second dipole section 42G2 arm section 38G2 is a meandered length which is also non-planar by being bent at lines 230 and 232. Arm section 40G2 comprises a first section 244 and a second section 246, angled with respect to section 244 by being bent at line 234. Arm sections 38G2 and 40G2 have different shapes.

Balun section 32G is substantially planar, except for an optional cable grip 248, and is coplanar and continuous with sections 236, 240, and 244 of dipoles 42G1 and 42G2. The balun section comprises an L-shaped gap 229 separating two sides 231, 233 of the balun.

A line 250 shows a path taken by a cable, via grip 248, connecting to feed sections 34G and 36G.

Antenna 220 comprises optional mounting holes 252 which are formed in section 246 of arm section 40G2.

Typical overall dimensions of template 228 are approximately 31 mm×20 mm, and antenna 220 when formed into its three-dimensional shape occupies a volume having approximate dimensions of 20 mm×20 mm×10 mm. The overall dimensions of template 228, and of the dimensions and/or locations and/or characteristics of the sections comprising antenna 220, may be altered, generally as described above with reference to antennas 50 and 70.

Figure 9:
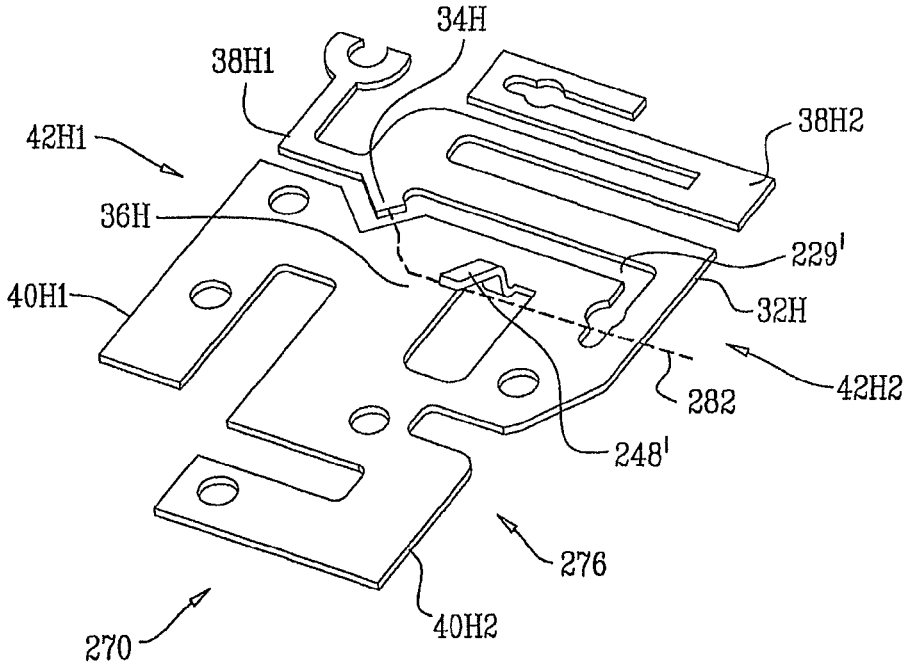
Figure 9:
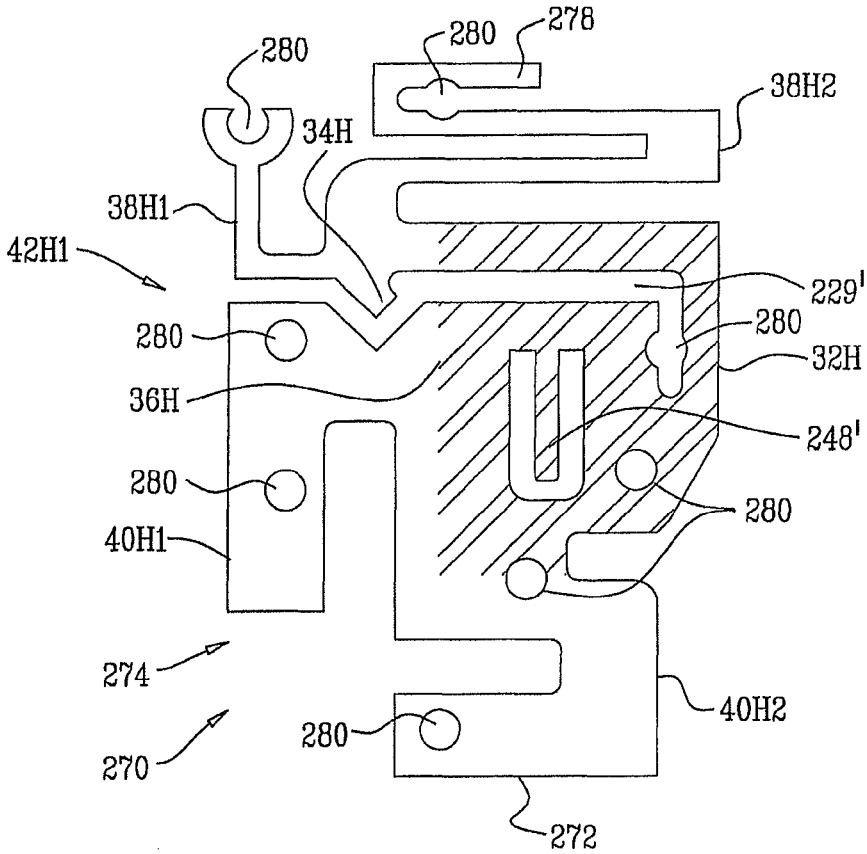

FIG. 9 is a schematic diagram of an antenna 270, according to an embodiment of the present invention. Antenna 270 is a single-feed dual band antenna operative, by way of example, at approximately 2.5 GHz and 5 GHz. Antenna 270 is formed as a generally two-dimensional antenna from a two-dimensional conductive template 272. Two views of antenna 270 are shown in FIG. 9: a first view 274 is of the antenna before it is formed into its final shape; a second view 276 is a perspective view of the antenna in its final shape.

Antenna 270 and antenna 220 (FIG. 8) are similar, differing mainly in the positioning of optional mounting holes, and the dimensions of elements of the respective antennas to accommodate the mounting holes. In addition, antenna 270 is a substantially two-dimensional antenna, whereas antenna 220 is three-dimensional. For simplicity, in the following description of antenna 270, the corresponding elements of antenna 220 are indicated in parentheses after the antenna 270 identification, or are distinguished by adding an apostrophe ' to the identifier.

Antenna 270 comprises a live feed point section 34H (34G) and a ground feed point section 36H (36G). Antenna 270 also comprises a substantially planar common balun section 32H (32G), which comprises an L-shaped gap 229', and within which is formed an optional cable grip 248'. A first dipole section 42H1 (42G1) of the antenna is formed of a first arm section 38H1 (38G1) and a second arm section 40H1 (40G1). A second dipole section 42H2 (42G2) of the antenna is formed of a first arm section 38H2 (38G2) and a second arm section 40H2 (40G2).

First arm section 38H2 differs from first arm section 38G2 (FIG. 8) in that an end element 278 of section 38H2 is shorter than the corresponding end element of section 38G2.

In place of mounting holes 252 of antenna 220, antenna 270 comprises optional mounting holes or openings 280.

A line 282 shows the path of a cable coupled to feed points 34H, 36H.

Typical overall dimensions of template 272 are approximately 40 mm×30 mm. The overall dimensions of template 272, and of the dimensions and/or locations and/or characteristics of the sections comprising antenna 270, may be altered, generally as described above with reference to antennas 50 and 70.

It will be understood that template 272 may be bent into a number of three-dimensional shapes, so that the template acts as a polymorphic antenna. For example, template 272 may be bent into a three-dimensional form similar to that of antenna 220 (FIG. 8).

Figure 10:
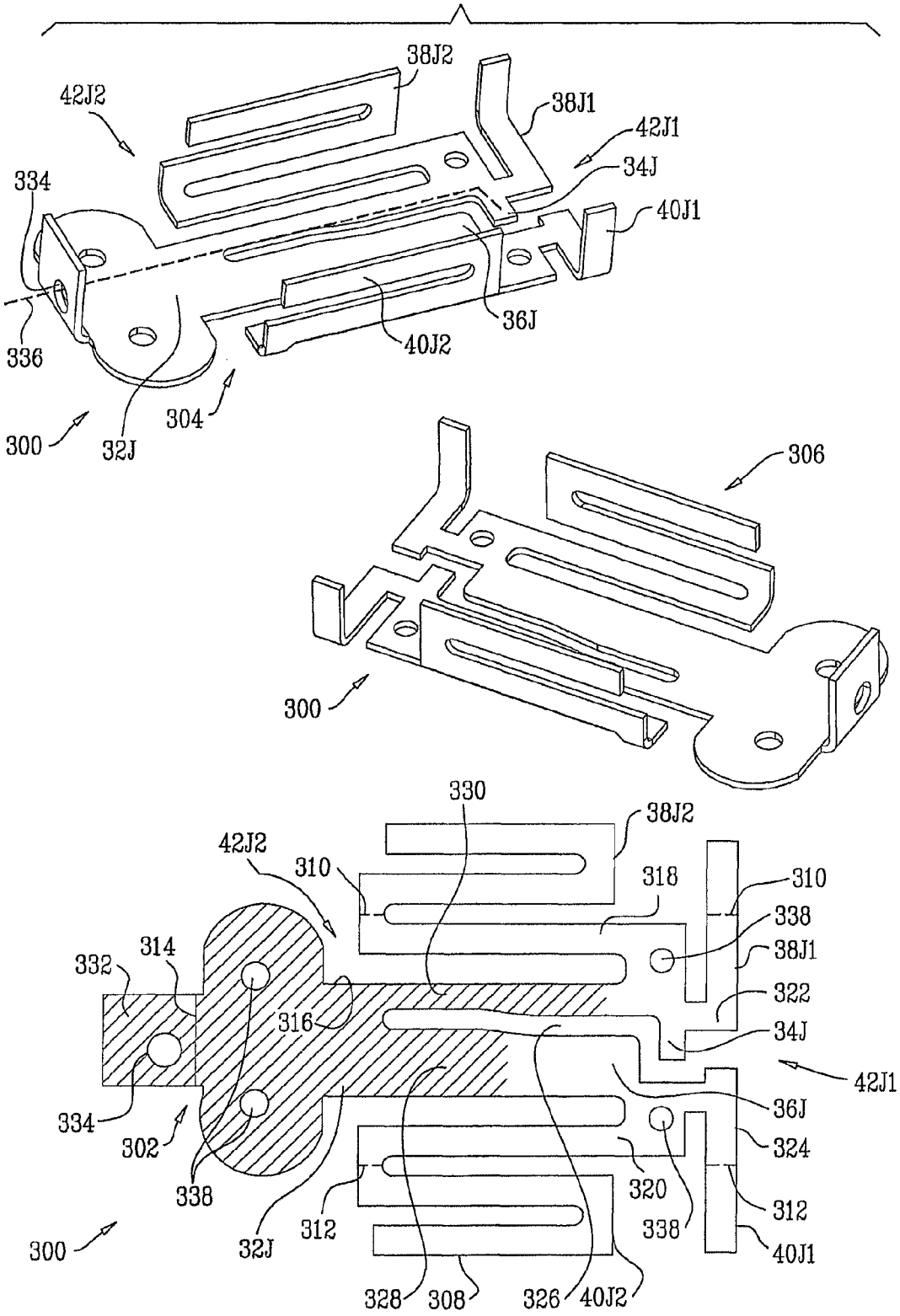

FIG. 10 is a schematic diagram of an antenna 300, according to an embodiment of the present invention. Antenna 300 is a single-feed dual band antenna operative, by way of example, at approximately 2.5 GHz and 5 GHz. FIG. 10 shows three views of antenna 300: a first view 302 is of the antenna before it is formed into its final shape, a second view 304 and a third view 306 are perspective views of the antenna in its finished form. View 302 is of a two-dimensional surface defining a conductive template 308, that has been formed, typically as described for antenna 50, into the shape shown in view 302. Antenna 300 is then formed into its finished shape by bending template 308 along lines 310, 312, and 314.

Antenna 300 comprises a live feed point section 34J and a ground feed point section 36J. A first dipole section 42J1 of the antenna is formed of a first arm section 38J1 and a second arm section 40J1. A second dipole section 42J2 of the antenna is formed of a first arm section 38J2 and a second arm section 40J2. Antenna 300 comprises a balun section 32J, which acts as a common balun for the first and the second dipole sections.

In first dipole section 42J1 arm sections 38J1 and 40J1 are approximately equal in length and are non-planar by being bent at lines 310 and 312 respectively. Arm section 38J1 has an L-shaped cross-section, and arm section 40J1 has a reverse-L shaped cross-section. The two arm sections are configured so that the sections are approximately mirror images of each other.

In second dipole section 42J2 arm sections 38J2 and 40J2 are meandered, are approximately equal in length, and are non-planar by being bent, as for arm sections 38J1 and 38J2, at lines 310 and 312 respectively. Arm section 38J2 has an L-shaped cross-section that is approximately the same as the L=shaped cross-section of arm section 38J1. Arm section 40J2 has a reverse-L shaped cross-section that is approximately the same as the reverse-L shaped cross-section of arm section 40J1. As for first dipole section 42J1, the two arm sections 38J2 and 40J2 are configured to be approximately mirror images of each other, and the two dipole sections have a common mirror plane.

Balun section 32J is non-planar and has an L-shaped cross-section by being bent at line 314. A first planar section 316 of the balun is coplanar and continuous with first planar sections 318, 320, 322, and 324 of arm sections 38J2, 40J2, 38J1, and 40J1 respectively. The balun section comprises an asymmetric approximately U-shaped gap 326 separating two sides 328, 330 of the balun. Balun section 32J comprises a second planar section 332, approximately orthogonal to section 316, that includes a cable guide hole 334.

A line 336 shows a path taken by a cable, via hole 334, connecting to feed sections 34J and 36J.

Antenna 300 comprises optional mounting holes 338 which are formed in section 316 of the balun and sections 318 and 320 of dipole 42J2.

Typical overall dimensions of template 308 are approximately 32 mm×23 mm, and antenna 300 when formed into its three-dimensional shape occupies a volume having approximate dimensions of 27 mm×13 mm×5 mm. The overall dimensions of template 308, and of the dimensions and/or locations and/or characteristics of the sections comprising antenna 300, may be altered, generally as described above with reference to antennas 50 and 70.

Figure 11:
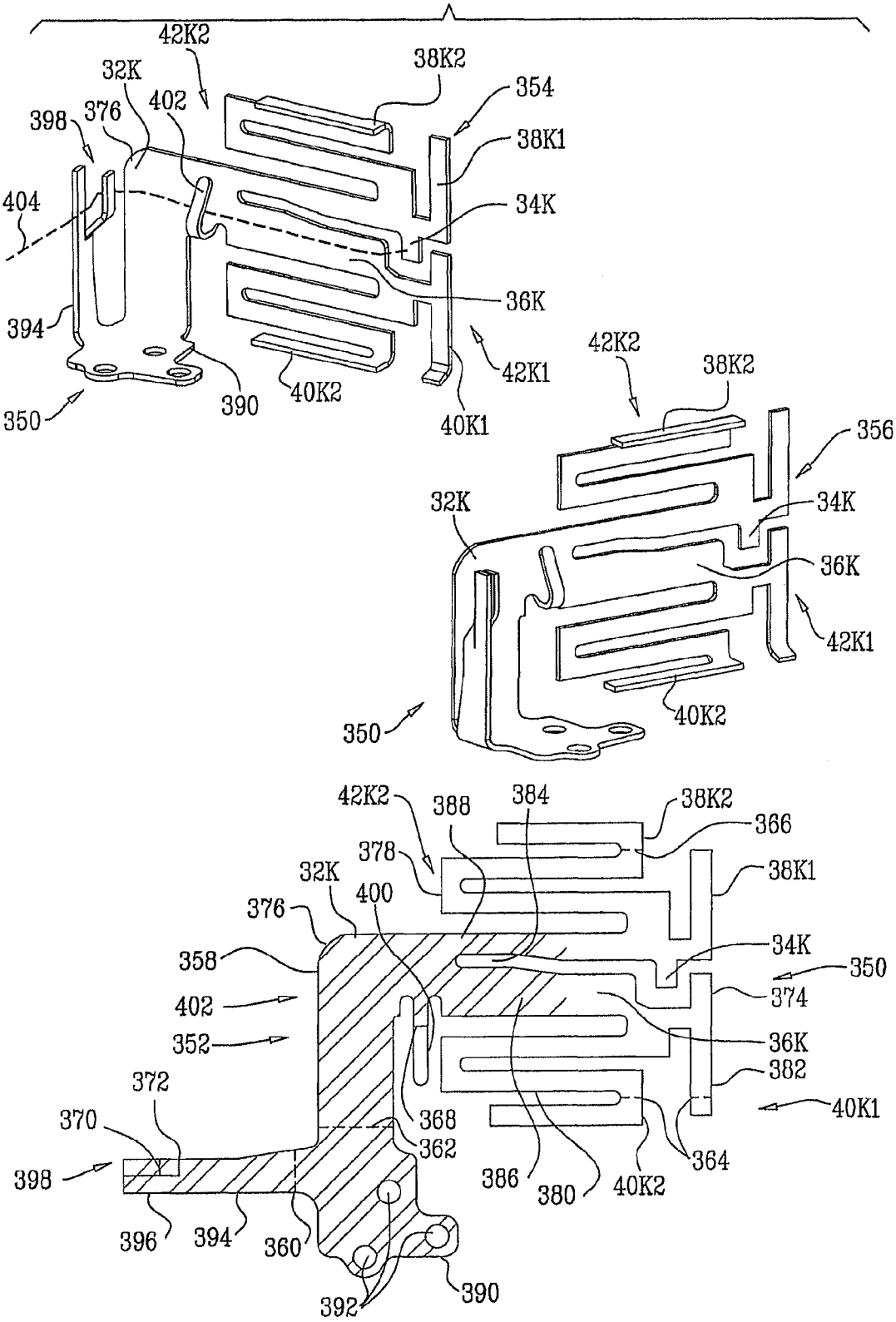

FIG. 11 is a schematic diagram of an antenna 350, according to an embodiment of the present invention. Antenna 350 is a single-feed dual band antenna operative, by way of example, at approximately 2.5 GHz and 5 GHz. FIG. 11 shows three views of antenna 350: a first view 352 is of the antenna before it is formed into its final shape, a second view 354 and a third view 356 are perspective views of the antenna in its finished form. View 352 is of a two-dimensional surface defining a conductive template 358, that has been formed, typically as described for antenna 50, into the shape shown in view 352. Antenna 350 is then formed into its finished shape by bending template 358 along lines 360, 362, 364, 366, 368, 370 and 372.

Antenna 350 comprises a live feed point section 34K and a ground feed point section 36K. A first dipole section 42K1 of the antenna is formed of a first arm section 38K1 and a second arm section 40K1. A second dipole section 42K2 of the antenna is formed of a first arm section 38K2 and a second arm section 40K2. Antenna 350 comprises a balun section 32K, which acts as a common balun for the first and the second dipole sections.

In first dipole section 42K1 arm sections 38K1 and 40K1 are un-equal in length. Arm section 38K1 is planar and linear. Arm section 40K1 has a planar section 374 that is coplanar with section 38K1, and section 40K1 has an L-shaped cross-section by being bent at line 364.

In second dipole section 42K2 arm sections 38K2 and 40K2 are meandered, are approximately equal in length, and are non-planar by being bent at lines 364 and 366 respectively. Arm section 38K2 has a reverse-L-shaped cross-section. Arm section 40K2 has an L-shaped cross-section that is approximately the same as the L-shaped cross-section of arm section 40K1. The two arm sections 38K2 and 40K2 are configured to be approximately mirror images of each other.

Balun section 32K is non-planar by being bent at lines 360 and 362. A first planar section 376 of the balun is coplanar and continuous with first planar sections 378 and 380 of arm sections 38K2 and 40K2 respectively. First planar section 376 is also coplanar and continuous with arm section 38K1, and with a first planar section 382 of arm section 40K1. The balun section comprises an asymmetric approximately U-shaped gap 384 separating two sides 386, 388 of the balun.

Balun section 32K comprises a second planar section 390, approximately orthogonal to section 376, that includes optional mounting holes 392.

Balun section 32K comprises a third section 394, approximately orthogonal to sections 376 and 390, that includes elements 396 for an optional first cable guide 398. A tongue 400 in balun section 32K is bent about line 368 to form an optional second cable guide 402.

A line 404 shows a path taken by a cable, via guides 398 and 402, connecting to feed sections 34K and 36K.

Typical overall dimensions of template 358 are approximately 41 mm×32 mm, and antenna 350 when formed into its three-dimensional shape occupies a volume having approximate dimensions of 29 mm×21 mm×10 mm. The overall dimensions of template 358, and of the dimensions and/or locations and/or characteristics of the sections comprising antenna 350, may be altered, generally as described above with reference to antennas 50 and 70.

Figure 12:
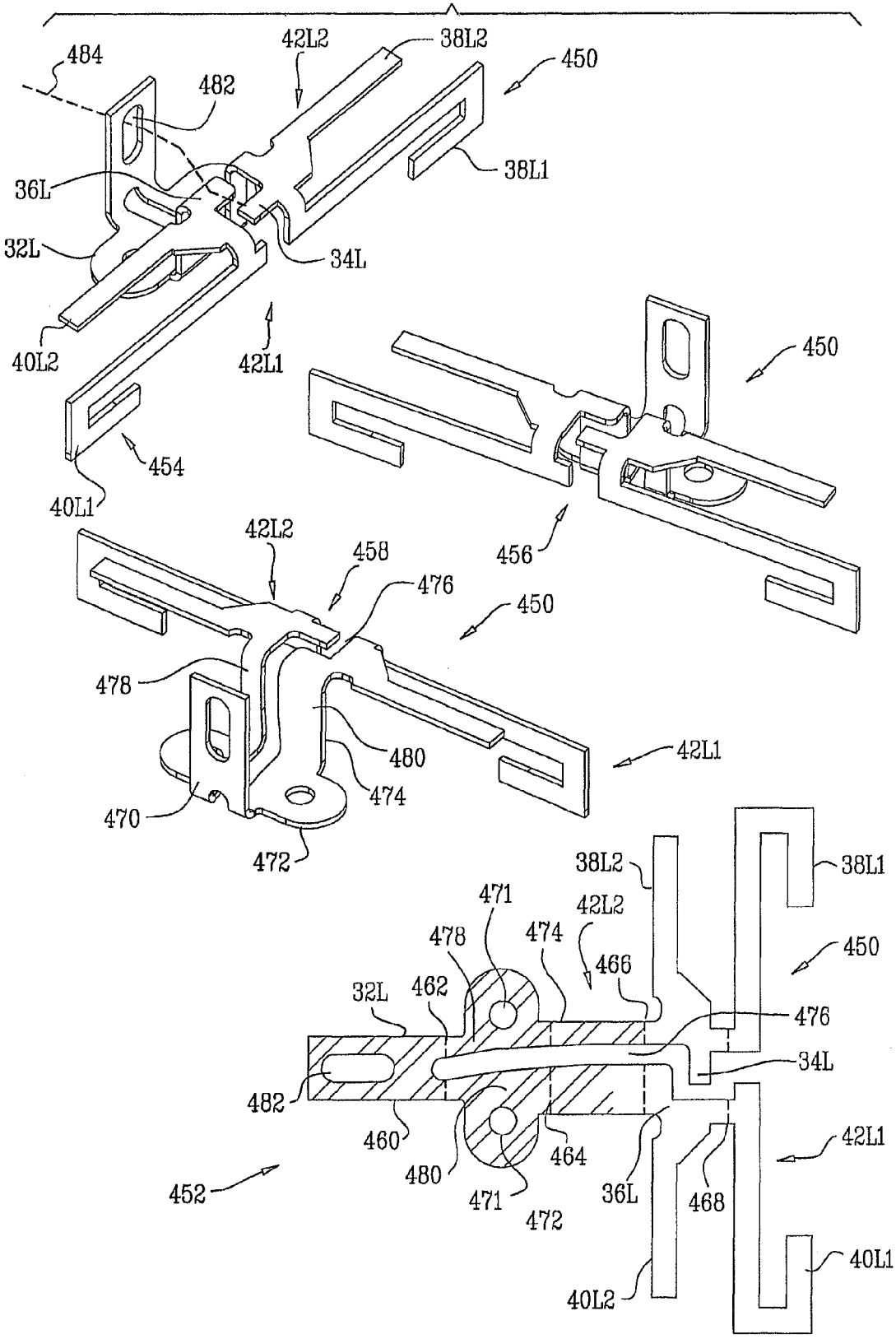

FIG. 12 is a schematic diagram of an antenna 450, according to an embodiment of the present invention. Antenna 450 is a single-feed dual band antenna operative, by way of example, at approximately 2.5 GHz and 5 GHz. FIG. 12 shows four views of antenna 450: a first view 452 is of the antenna before it is formed into its final shape, a second view 454, a third view 456, and a fourth views 458 are perspective views of the antenna in its finished form. View 452 is of a two-dimensional surface defining a conductive template 460, that has been formed, typically as described for antenna 50, into the shape shown in view 452. Antenna 450 is then formed into its finished shape by bending template 460 along lines 462, 464, 466 and 468.

Antenna 450 comprises a live feed point section 34L and a ground feed point section 36L. A first dipole section 42L1 of the antenna is formed of a first arm section 38L1 and a second arm section 40L1. A second dipole section 42L2 of the antenna is formed of a first arm section 38L2 and a second arm section 40L2. Antenna 450 comprises a balun section 32L, which acts as a common balun for the first and the second dipole sections.

In first dipole section 42L1 arm sections 38L1 and 40L1 are planar meandered sections which are coplanar with each other, and which are approximately mirror images of each other.

In second dipole section 42L2 arm sections 38L2 and 40L2 are approximately equal in length, and are linear and planar. Sections 38L2 and 40L2 are coplanar with each other, and are configured to be approximately mirror images of each other. The two dipoles each have a mirror plane which is approximately the same.

Antenna 452 is bent at line 468 so that dipole section 42L1 and dipole section 42L2 are approximately orthogonal to each other.

As is illustrated in view 458, balun section 32L is non-planar by being bent at lines 462, 464, and 466. The bends of the balun configure a first planar section 470 and a third planar section 474 of the balun to be parallel with dipole section 42L1. A second planar section 472 of the balun, between sections 470 and 474, is parallel to dipole section 42L2, so that a cross-section of antenna 450 is in the form of a square-wave. The balun section comprises an asymmetric gap 476 separating two sides 478, 480 of the balun.

First section 470 of the balun section comprises an optional opening that is used as a cable guide 482. Second section 472 comprises optional mounting holes 471.

As illustrated in view 454, a line 484 shows a path taken by a cable, via guide 482, connecting to feed sections 34L and 36L.

Typical overall dimensions of template 460 are approximately 36 mm×31 mm, and antenna 450 when formed into its three-dimensional shape occupies a volume having approximate dimensions of 36 mm×10 mm×9 mm. By being bent to have a concertina-like, square-wave, cross-section, antenna 450 is extremely compact. The overall dimensions of template 460, and of the dimensions and/or locations and/or characteristics of the sections comprising antenna 450, may be altered, generally as described above with reference to antennas 50 and 70.

Figure 13:
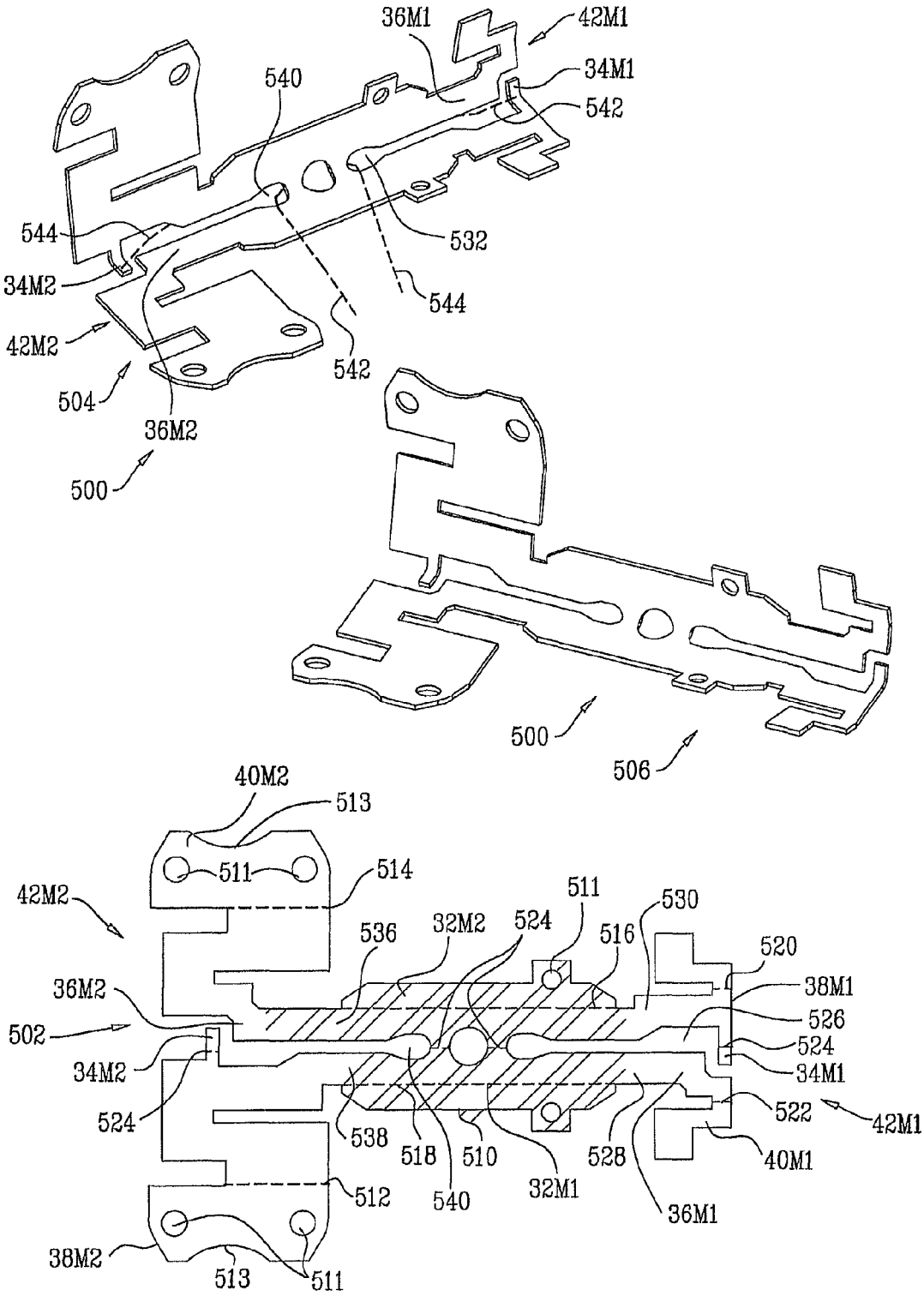

FIG. 13 is a schematic diagram of an antenna 500, according to an embodiment of the present invention. Antenna 500 is a dual-feed dual band antenna operative, by way of example, at approximately 2.5 GHz and 5 GHz. FIG. 13 shows three views of antenna 500: a first view 502 is of the antenna before it is formed into its final shape, a second view 504 and a third views 506 are perspective views of the antenna in its finished form. View 502 is of a two-dimensional surface defining a conductive template 510, that has been formed, typically as described for antenna 50, into the shape shown in view 502. Antenna 500 is then formed into its finished shape by bending template 510 along lines 512, 514, 516, 518, 520, 522, and 524.

Antenna 500 comprises a first live feed point section 34M1 and a first ground feed point section 36M1. A first dipole section 42M1 of the antenna is coupled to the first live and ground sections and is formed of a first arm section 38M1 and a second arm section 40M1.

The antenna also comprises a second live feed point section 34M2 and a second ground feed point section 36M2. A second dipole section 42M2 of the antenna is coupled to the second live and ground feed point sections, and is formed of a first arm section 38M2 and a second arm section 40M2.

Antenna 500 comprises a first balun section 32M1 which acts as a transformer for first dipole section 42M1. The antenna also comprises a second balun section 32M2 which acts as a transformer for second dipole section 42M2. While balun sections 32M1 and 32M2 are formed from continuous planes of template 510, the baluns act generally independently.

First balun section 32M1 comprises an asymmetric gap 526 which separates two sides 528, 530 of the balun. The gap ends in an optional opening 532 which is used, as described below, as a cable guide and strain relief. Second balun section 32M2 also has an asymmetric gap, gap 534, which separates two sides 536, 538 of the second balun. Gap 534 also ends in an optional opening 540 which is used as a cable guide and strain relief.

In first dipole section 42M1 arm sections 38M1 and 40M1 are non-planar meandered sections which are approximately mirror images of each other.

In second dipole section 42M2 arm sections 38L2 and 40L2 are also non-planar meandered sections which are approximately mirror images of each other. The two dipole sections each have a mirror plane which is approximately the same.

Template 510 comprises optional mounting holes 511 and optional indentations 513 which may be used to mount antenna 500 to a receiving structure, typically a housing wherein the antenna is operative.

View 504 illustrates coupling of antenna 500 to coaxial cables. A first line 542 shows the path of a first cable, the cable feeding through opening 540, the opening of the second balun, to live and ground sections 34M1, 36M1 of first dipole section 42M1. A second line 544 shows the path of a second cable feeding through opening 532, the opening of the first balun, to live and ground sections 34M2, 36M2 of second dipole section 42M2.

Typical overall dimensions of template 510 are approximately 45 mm×34 mm, and antenna 500 when formed into its three-dimensional shape occupies a volume having approximate dimensions of 45 mm×20 mm×16 mm. The overall dimensions of template 510, and of the dimensions and/or locations and/or characteristics of the sections comprising antenna 500, may be altered, generally as described above with reference to antennas 50 and 70.

Figure 14:
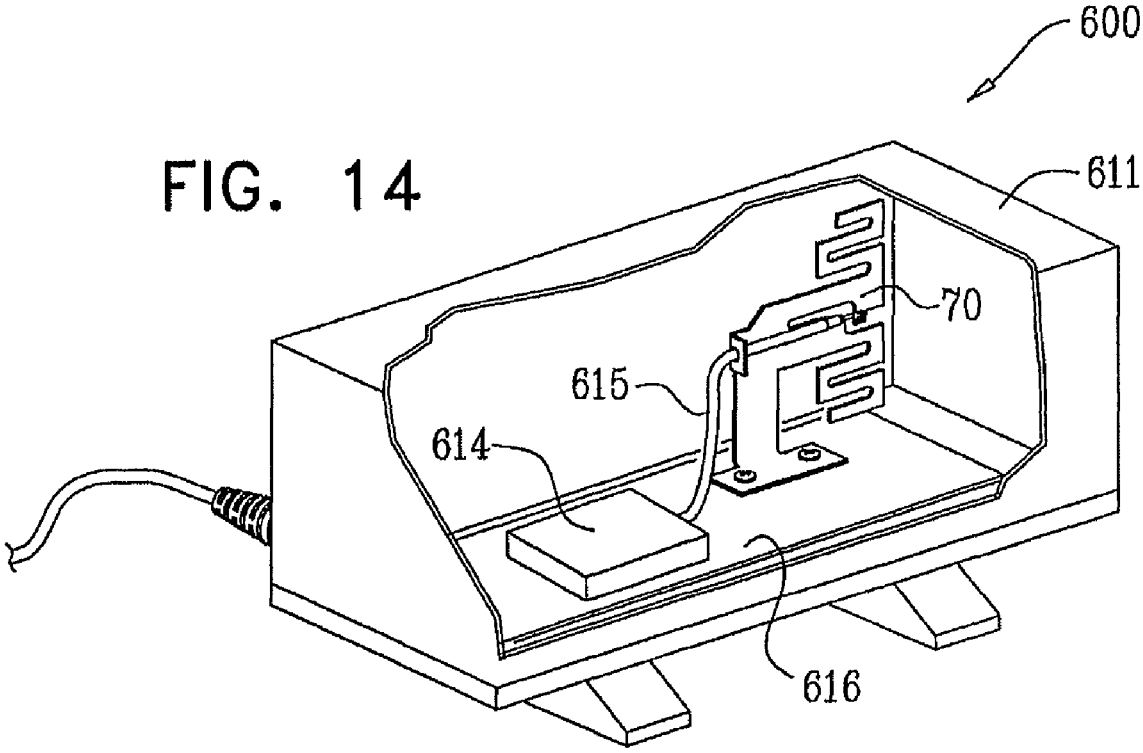
FIG. 14 is a schematic diagram of a communication device, according to an embodiment of the present invention.

FIG. 14 is a schematic diagram of a communication device 600, according to an embodiment of the present invention. Device 600 is typically a router or a device such as a printer that is used in a wireless network system, and the device is hereinbelow assumed to comprise a router. Router 600 has an enclosure 611, within which operational elements of the router are mounted, the operational elements including a transceiver 614.

By way of example, antenna 130 (FIG. 5), is assumed to be coupled to transceiver 614 by a feed 615, and the antenna is assumed to be within enclosure 611. Also by way of example, transceiver 614 and antenna 130 are assumed to be mounted on a printed circuit board 616, and the antenna is assumed to be oriented so that its radiation is mainly vertically polarized. However, it will be understood that any other of the antennas described hereinbove may replace antenna 130, and be coupled to transceiver 614 by feed 615. It will also be understood that the antenna installed within enclosure 611 may be oriented in any convenient orientation, to give a desired polarization.

Feed 615 may be any convenient system that efficiently transfers radio-frequency currents between the transceiver and the antenna, and is herein by way of example assumed to comprise a coaxial cable.

It will be appreciated that the embodiments described above are cited by way of example, and that the present invention is not limited to what has been particularly shown and described hereinabove. Rather, the scope of the present invention includes both combinations and subcombinations of the various features described hereinabove, as well as variations and modifications thereof which would occur to persons skilled in the art upon reading the foregoing description and which are not disclosed in the prior art.

We claim:

1. A polymorphic omni-directional antenna, comprising:

a metallic template configurable in at least first and second possible different three-dimensional shapes, said antenna, when configured in said at least first and second different three-dimensional shapes, having:

a common antenna feed point;

a common balun directly coupled to the common antenna feed point; and a common dipole directly coupled to the common antenna feed point and to the common balun, and said antenna operating omni-directionally in a common frequency band when configured in either of said at least first and second different three-dimensional shapes and fed via the common antenna feed point.

2. The antenna according to claim 1, wherein said antenna when configured in either of said at least first and second different three-dimensional shapes is free-standing.

3. The antenna according to claim 1, and comprising a cable guide.

4. The antenna according to claim 3, wherein the cable guide and the common balun are formed in a common section of the metallic template.

5. The antenna according to claim 3, wherein the cable guide and an arm of the common dipole are formed in a common section of the metallic template.

6. The antenna according to claim 1, wherein the common dipole comprises a first arm having a first shape and a second arm having a second shape different from the first shape.

7. The antenna according to claim 1, wherein the common dipole comprises a first arm and a second arm that is a mirror image of the first arm.

8. The antenna according to claim 1, and comprising at least one mounting hole.

9. The antenna according to claim 8, wherein the at least one mounting hole and the common balun are formed in a common section of the metallic template.

10. The antenna according to claim 8, wherein the at least one mounting hole and the common dipole are formed in a common section of the metallic template.

11. The antenna according to claim 1, wherein the common dipole comprises a first dipole operative at a first frequency band and a second dipole operative at a second frequency band different from the first frequency band.

12. The antenna according to claim 11, wherein the common antenna feed point comprises a first antenna feed point coupled to the first dipole and a second antenna feed point coupled to the second dipole.

13. The antenna according to claim 12, wherein the common balun comprises a first balun coupled to the first antenna feed point and a second balun coupled to the second antenna feed point.

14. A method for implementing a polymorphic omni-directional antenna, comprising:

configuring a metallic template in at least first and second possible different three-dimensional shapes;

arranging said antenna, when the metallic template is configured in said at least first and second different three-dimensional shapes, to have:

a common antenna feed point, a common balun directly coupled to the common antenna feed point, and a common dipole directly coupled to the common antenna feed point and to the common balun; and arranging said antenna to operate omni-directionally in a common frequency band when configured in either of said at least first and second different three-dimensional shapes and fed via the common antenna feed point.

15. The method according to claim 14, wherein said antenna when configured in either of said at least first and second different three-dimensional shapes is free-standing.

16. The method according to claim 14, and comprising forming a cable guide and the common balun in a common section of the metallic template.

17. The method according to claim 14, and comprising forming a cable guide and an arm of the common dipole in a common section of the metallic template.

18. The method according to claim 14, wherein the common dipole comprises a first arm having a first shape and a second arm having a second shape different from the first shape.

19. The method according to claim 14, wherein the common dipole comprises a first dipole operative at a first frequency band and a second dipole operative at a second frequency band different from the first frequency band.

20. The method according to claim 19, wherein the common antenna feed point comprises a first antenna feed point coupled to the first dipole and a second antenna feed point coupled to the second dipole.

21. The method according to claim 20, wherein the common balun comprises a first balun coupled to the first antenna feed point and a second balun coupled to the second antenna feed point.

22. A communication device, comprising:

a transceiver; and an omni-directional antenna comprising:

a metallic template configurable in at least first and second possible different three-dimensional shapes, said antenna, when configured in said at least first and second different three-dimensional shapes, having:

a common antenna feed point coupled to the transceiver;

a common balun directly coupled to the common antenna feed point; and a common dipole directly coupled to the common antenna feed point and to the common balun, and said antenna operating omni-directionally in a common frequency band when configured in either of said at least first and second different three-dimensional shapes and fed via the common antenna feed point.

23. A method for producing a communication device, comprising:

providing a transceiver; and coupling an omni-directional antenna to the transceiver, the antenna comprising:

a metallic template configurable in at least first and second possible different three-dimensional shapes, said antenna, when configured in said at least first and second different three-dimensional shapes, having:

a common antenna feed point coupled to the transceiver;

a common balun directly coupled to the common antenna feed point; and a common dipole directly coupled to the common antenna feed point and to the common balun, and said antenna operating omni-directionally in a common frequency band when configured in either of said at least first and second different three-dimensional shapes and fed via the common antenna feed point.

* * * * *